US005680849A

United States Patent [19]

Morikawa et al.

[11] Patent Number: 5,680,849

[45] Date of Patent: Oct. 28, 1997

[54] PURGING OF EVAPORATED FUEL TO ENGINE INTAKE WITH ENGINE FUEL CORRECTION UPON DETECTION OF MALFUNCTION IN PURGING SYSTEM

[75] Inventors: Junya Morikawa, Kasugai; Katsuhiko Nakabayashi, Handa, both of Japan

[73] Assignee: Nippondenso Co., Ltd., Kariya, Japan

[21] Appl. No.: 703,066

[22] Filed: Aug. 26, 1996

[30] Foreign Application Priority Data

Sep. 1, 1995 [JP] Japan ..... 7-225199

[51] Int. Cl.[6] ..... F02M 37/04

[52] U.S. Cl. ..... 123/520; 123/198 D; 123/357

[58] Field of Search ..... 123/198 D, 520, 123/357, 519, 518, 521, 516

[56] References Cited

U.S. PATENT DOCUMENTS

| | | | |
|---|---|---|---|
| 4,961,412 | 10/1990 | Furuyama | 123/357 |
| 5,299,546 | 4/1994 | Kato | 123/198 D |
| 5,315,980 | 5/1994 | Otsuka et al. . | |
| 5,317,909 | 6/1994 | Yamada et al. . | |
| 5,333,589 | 8/1994 | Otsuka | 123/198 D |
| 5,345,917 | 9/1994 | Maruyama et al. . | |
| 5,359,980 | 11/1994 | Tomisawa | 123/520 |
| 5,445,133 | 8/1995 | Nemoto | 123/198 D |
| 5,469,832 | 11/1995 | Nemoto | 123/520 |
| 5,520,160 | 5/1996 | Aoto | 123/520 |

*Primary Examiner*—Carl S. Miller

*Attorney, Agent, or Firm*—Nixon & Vanderhye P.C.

[57] ABSTRACT

An evaporated fuel gas purging system performs breakdown analysis without deterioration of drivability and exhaust emission even when the amount of purged fuel gas is large. During introduction of negative pressure into the purge system, a control value DUTY sets opening of a purge control valve and a purge flow amount GPG is derived from a map based on differences in the control value DUTY, atmospheric pressure and intake pipe pressure. Thereafter, a purge ratio PGR is calculated from intake air GA and purge flow GPG (PGR=GPG/GA), and a fuel injection correction value FAFLEAK=PGR×(FGPGAV−1)×K1 is calculated, with FGPGAV−1 being the air-fuel ratio feedback correction deviation per 1% purge ratio, and K1 being an error correction coefficient. Then, the fuel injection correction FAFLEAK is guard-processed to maintain it below an upper limit guard value KFLEAKMX.

15 Claims, 15 Drawing Sheets

FULL-OPEN RATE MAP
(PGRMX)

(mmHg)

| NE \ PM | 291 | 369 | 447 | 525 | 603 | 651 | 759 |
|---|---|---|---|---|---|---|---|
| 800 | 20.1 | 14.5 | 11.2 | 8.6 | 6.2 | 4.6 | 0.0 |
| 1200 | 12.5 | 9.3 | 7.2 | 5.5 | 4.0 | 2.9 | 0.0 |
| ⋮ | ⋮ | ⋮ | ⋮ | ⋮ | ⋮ | ⋮ | ⋮ |
| 3600 | 4.1 | 3.0 | 2.2 | 1.7 | 1.3 | 0.9 | 0.0 |
| 4000 | 3.4 | 2.4 | 1.8 | 1.4 | 1.1 | 0.8 | 0.0 |

(rpm) (%)

FUEL EVAPORATION GAS DETECTION
401
KEY SWITCH ON TIME?
YES
NO
402
XPRG=1?
NO
YES
403
ACCEL./DECEL.?
YES
NO
404
XNFGPG=1?
NO
YES
405
PGR>β%?
NO
YES
406
|1-FAFAV| >ω%?
NO
YES
407
FGPG = FGPG(i-1)+ FAFAV-1 / PGR
408
XNFGPG=1?
YES
NO
409
STABLE ?
NO
YES
410
XNFGPG=1
411
CALCULATE FGPGAV
RETURN
412
FGPG=1.0
413
FGPGAV=1.0
414
XNFGPG=0
RETURN

PURGE CONTROL VALVE

CANISTER CLOSING VALVE

FIG. 20

GPG MAP( g/sec)

| DUTY \ Pa-PM (mmHg) | 0 | 156 | 312 | 468 | 624 |
|---|---|---|---|---|---|
| 0 (%) | 0 | 0 | 0 | 0 | 0 |
| 12.5 | 0 | 0.03 | 0.05 | 0.08 | 0.10 |
| 25.0 | 0 | 0.05 | 0.10 | 0.16 | 0.21 |
| 37.5 | 0 | 0.08 | 0.15 | 0.23 | 0.30 |
| 50.0 | 0 | 0.10 | 0.21 | 0.31 | 0.41 |
| 62.5 | 0 | 0.13 | 0.25 | 0.38 | 0.50 |
| 75.0 | 0 | 0.16 | 0.31 | 0.47 | 0.62 |
| 87.5 | 0 | 0.18 | 0.36 | 0.54 | 0.72 |
| 100 | 0 | 0.21 | 0.41 | 0.62 | 0.82 |

FIG. 21

KFLEAKMX TABLE

| Pa-PM(mmHg) | 0 | 156 | 312 | 468 | 624 |
|---|---|---|---|---|---|
| KFLEAKMX | 0.5 | 0.5 | 0.4 | 0.3 | 0.3 |

FIG. 24

KFLEAKMX TABLE

| PM(mmHg) | 156 | 312 | 468 | 624 | 780 |
|---|---|---|---|---|---|
| KFLEAKMX | 0.3 | 0.3 | 0.4 | 0.5 | 0.5 |

PURGING OF EVAPORATED FUEL TO ENGINE INTAKE WITH ENGINE FUEL CORRECTION UPON DETECTION OF MALFUNCTION IN PURGING SYSTEM

BACKGROUND OF THE INVENTION

1. Field of the Invention

The present invention relates to purging of evaporated fuel gas adsorbed in a canister into an intake pipe of an internal combustion engine.

2. Description of Related Art

Conventionally, in an evaporated fuel gas purging system to prevent evaporated fuel gas (HC) generated in a fuel tank from leaking into the atmosphere, evaporated fuel gas generated in the fuel tank is adsorbed into a canister. A purge control valve is provided midway within a purge passage for purging the evaporated fuel gas adsorbed in this canister into an intake pipe of the internal combustion engine. The flow of the purged fuel into the intake pipe from the canister is controlled by controlling the opening and closing of the purge control valve according to the engine operating conditions.

When this purging system breaks down, the evaporated fuel gas is released into the atmosphere. There are systems such as that disclosed in U.S. Pat. No. 5,317,909 for example which effectively analyze breakdowns or detect malfunctions such as pressure leakage etc. in the purging system (e.g. based on pressure by introducing and maintaining negative intake pressure into the purge system, or pressure fluctuations thereafter).

In such systems, upon introduction of intake negative pressure into the purge system, evaporated fuel gas from the canister is circulated into the intake pipe. Where the amount of evaporated fuel gas generated is large, the air-fuel ratio of air-fuel mixture is changed toward the rich side (rich-in-fuel side) and this gives rise to a detrimental effect on drivability and engine exhaust emission control.

Thus, as disclosed in U.S. Pat. No. 5,345,917 and U.S. Pat. No. 5,315,980, the amount of evaporated fuel evaporation gas generation is detected based on fuel tank internal pressure, fuel temperature and air-fuel ratio feedback correction amount. Where-this is large, breakdown analysis (introduction of intake pipe negative pressure into the purge system) is prohibited.

However, in summer when the outside temperature is high, the amount of evaporated fuel gas increases. Upon continuously prohibiting breakdown analysis when fuel gas generation is large, as in the systems of the above patents, the chance of executing breakdown analysis execution chance in summer becomes extremely low. As a result, even if a breakdown actually occurs in the purge system in summer time, detecting the breakdown is delayed and it is possible that during that delay evaporated fuel gas is released into the atmosphere.

SUMMARY OF THE INVENTION

The present invention has as its object to provide an evaporated fuel gas purging system which can perform breakdown analysis without deterioration of drivability and emissions and which can rapidly find breakdowns even when the amount of fuel gas generated is large.

According to the present invention, a fuel gas evaporation purge system has a canister for adsorbing fuel gas generated from a fuel tank, a purge passage for purging the fuel gas adsorbed within the canister to an intake pipe of an internal combustion engine, and a purge control valve for controlling the amount of purged fuel gas according to engine operating conditions. Further, breakdowns in the purge system are effectively analyzed based on pressure when introducing an intake pipe negative pressure into the purge system by opening the purge control valve or a pressure variation thereafter. When an intake pipe negative pressure is introduced into the purge system by opening the purge control valve, the fuel injection into the internal combustion engine is corrected according to the flow of fuel gas purged from the canister to the intake pipe. In this structure, when an intake pipe negative pressure is introduced into the purge system, the amount of injected fuel is corrected according to the purge flow into the intake pipe. Consequently, when the amount of fuel gas generated is large, even where the intake pipe negative pressure is introduced and breakdown analysis is executed, the fuel gas injection is corrected according to the purge gas flow at that time, change of the engine air-fuel ratio towards rich is prevented and drivability and emissions are not adversely affected.

Preferably, an air-fuel ratio feedback correction amount deviation per 1% of a ratio of intake air to purge flow (herebelow referred to as "purge ratio") is stored, and the purge control valve opening is controlled so that introduction of intake pipe negative pressure into the purge system provides a predetermined purge ratio. A fuel injection correction value is calculated by multiplying the purge ratio when intake pipe negative pressure is introduced into the purge system by the air-fuel ratio feedback correction deviation per 1% purge ratio.

Further, it is preferable for an air-fuel ratio feedback correction deviation per 1% purge ratio to be stored and the purge control valve is controlled to a predetermined opening during introduction of intake pipe negative pressure into the purge system. A purge ratio is obtained by calculating purge flow from the pressure difference between purge control valve opening and the intake pipe negative pressure at that time, (or the intake pipe negative pressure and atmospheric pressure), and a fuel injection correction value is calculated by multiplying the purge ratio when intake pipe negative pressure is introduced into the purge system by the air-fuel ratio feedback correction deviation per 1% purge ratio.

Preferably, errors are corrected by closing an outside valve during breakdown analysis, and an error correction coefficient is updated based on an air-fuel ratio feedback correction deviation during intake pipe negative pressure introduction. Thereby, the error correction coefficient tends toward an optimum value according to the air-fuel ratio control state at that time, and the fuel injection correction value can be more precisely obtained.

Moreover, it is preferable to limit the fuel injection correction value to below an upper limit guard value. Thereby, excessive correction of the fuel injection amount is prevented and control is stabilized.

Even more preferably, the upper limit guard value is varied according to the intake pipe negative pressure or atmospheric pressure, (or a pressure difference between the intake pipe negative pressure) and atmospheric pressure. This is for when the change amount of the fuel injection amount during intake pipe negative pressure introduction changes according to intake pipe negative pressure or atmospheric pressure.

Also introduction of intake pipe negative pressure and breakdown analysis are stopped when the fuel injection correction value is above a predetermined value, or when the fuel injection correction value is above a predetermined value and the air-fuel ratio feedback correction deviation is above a predetermined value, or when the fuel injection correction value is above a predetermined value and the purge control valve opening is below a predetermined value.

BRIEF DESCRIPTION OF THE DRAWINGS

These and other features, aspects and advantages of the present invention will become better understood with reference to the following description, appended claims and accompanying drawings, wherein:

FIG. 20 is a table showing a two-dimensional map for obtaining a purge flow amount GPG from a control value DUTY and Pa–PM (difference between atmospheric pressure Pa and intake pipe pressure PM), FIG. 21 is a data table for obtaining an upper limit guard value KFLEAKMX from Pa–PM (difference between atmospheric pressure Pa and intake pipe pressure PM), FIG. 24 is a data table for obtaining the upper limit guard value KFLEAKMX from the intake pipe pressure PM.

DETAILED DESCRIPTION OF EXEMPLARY EMBODIMENTS

Figure 1:
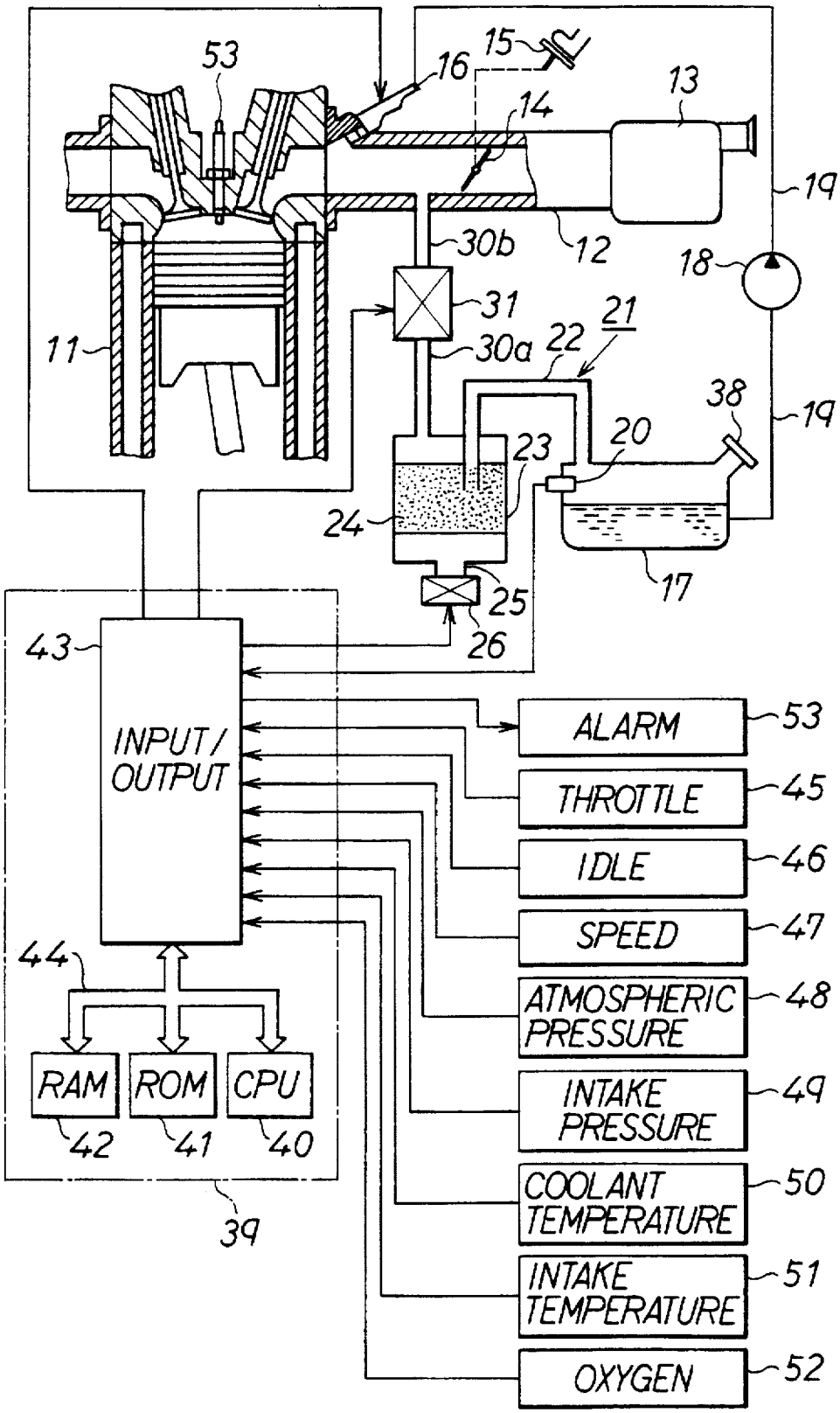
FIG. 1 is an overall structural view of an entire system showing an embodiment of the present invention.

Herebelow, an embodiment of the present invention will be explained based on the accompanying drawings. Firstly, the overall structure of the entire system will be explained based on FIG. 1.

An air cleaner 13 is provided at the upstream side of an intake pipe or pipe 12 of an internal combustion engine 11, and air which has passed through this air cleaner 13 is taken in by each cylinder of the engine 11 through a throttle valve 14. The opening amount of the throttle valve 14 is adjusted by the amount by which an accelerator pedal 15 is depressed. Also, a fuel injection valve 16 is provided for each cylinder in the intake pipe 12. Fuel (gasoline) from inside a fuel tank 17 is sent to each fuel injection valve 16 by a fuel pump 18 via fuel line 19. A pressure sensor 20 such as a semiconductor pressure sensor or the like for detecting the internal pressure of the fuel tank 17 is provided in the fuel tank 17.

Next, the structure of a purge system 21 will be explained. A canister 23 is connected to the fuel tank 17 via a connecting line 22. Inside this canister 23 an adsorbent 24 such as activated carbon or the like for adsorbing evaporated fuel gas is housed. Also, an outside connecting hole 25 communicating with the outside air is provided in the lower face portion of the canister 23, and a canister closing valve 26 is attached to this outside connecting hole 25.

Figure 2:
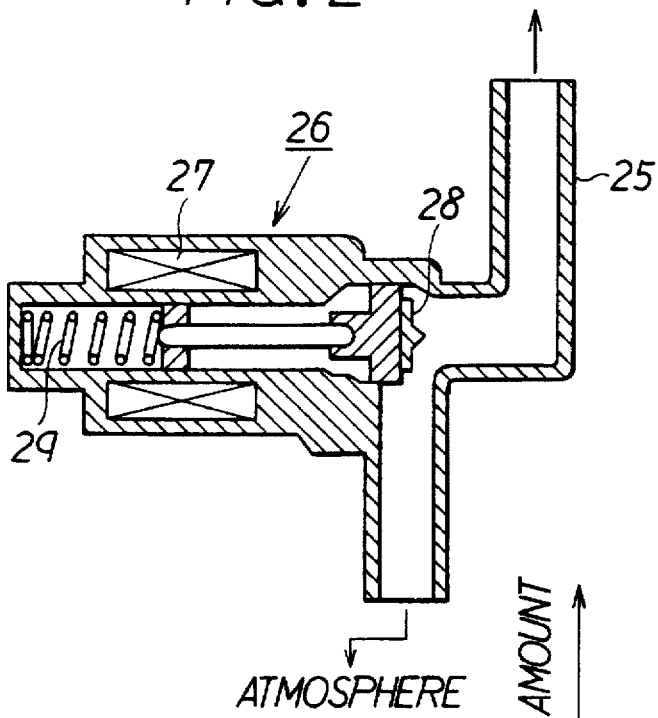
FIG. 2 is a cross-sectional view of a canister closing valve.

This canister closing valve 26 is formed from an electromagnetic valve, and in a state where excitation to a solenoid coil 27 is off as shown in FIG. 2, a valve 28 is urged to an opening position by a spring 29 and the outside connecting hole 25 of the canister 23 is kept in a state where it is open to the outside air (atmosphere). Then, upon a predetermined voltage (6 volts or more for example) being applied to the solenoid coil 27, the valve 28 moves to a closed position against the urging force of the spring 29, and the outside connecting hole 25 enters a closed state by means of the valve 28.

Figure 3:
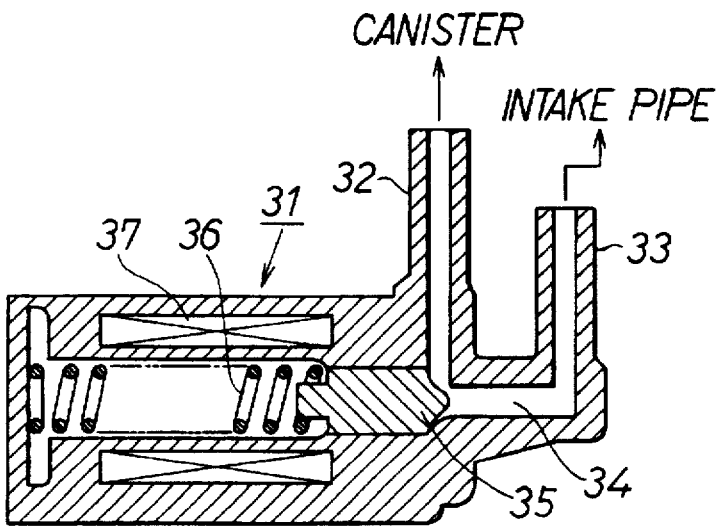
FIG. 3 is a cross-sectional view of a purge control valve.

Meanwhile, as shown in FIG. 1, purge passages **30*a* and 30*b* are provided between the canister 23 and the intake pipe 12 for purging (discharging) the fuel evaporation gas adsorbed by the adsorbent 24 to the intake pipe 12, and between these purge passages 30*a* and 30*b* a purge control valve 31 is provided for adjusting the purge flow amount. This purge control valve 31, as shown in FIG. 3, is an electromagnetic valve comprising a port 32 connected to the purge passage 30*a* on the canister 23 side, a port 33 connected to the purge passage 30*b* on the intake pipe 12 side, a valve 35 for opening/closing midway along a passage 34 between the two ports 32 and 33, a spring 36 for urging the valve 35 in a closing direction, and a solenoid coil 37 for moving the valve 35 in an opening direction against the urging force of the spring 36**.

Figure 4:
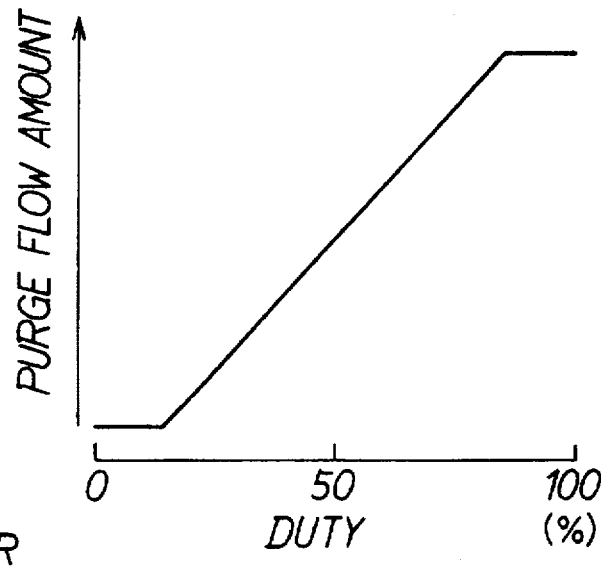
FIG. 4 is a graph indicating the relationship between a purge control valve drive DUTY and a purge flow amount.

A voltage is applied to the solenoid coil 37 of this purge control valve 31 by a pulse signal, and by changing the ratio of the pulse width to the cycle of the pulse signal (DUTY ratio), the ratio of the opening time of the valve 35 to the opening/closing cycle of the valve 35 is changed and the purge flow amount of the fuel evaporation gas from the canister 23 to the intake pipe 12 is controlled. The variation characteristic of the drive DUTY to purge flow amount of the purge control valve 31 is shown in FIG. 4.

Also, as shown in FIG. 1, a relief valve 38 is provided on the fuel tank 17, the relief valve 38 opening and releasing pressure when the internal pressure within the fuel tank 17 reaches an internal pressure exceeding −40 mmHg to 150 mmHg (relief pressure). Accordingly, the space between the fuel tank 17 and the canister 23 is continually suppressed to below a pressure fluctuation within the relief pressure range.

Next, the structure of the control system will be explained based on FIG. 1. An electronic control unit 39 is formed by connecting a CPU 40, a ROM 41 in which various types of control programs and data to be described later are stored, a RAM 42 (memory means) for temporarily storing input data, calculation data, etc., an input-output circuit 43, and the like via a common bus 44. Also, various types of driving state or operating condition detectors such as a throttle sensor 45, idle switch 46, car speed sensor 47, outside air or atmospheric pressure sensor 48, intake pipe pressure sensor 49, cooling water or coolant temperature sensor 50, intake air temperature sensor 51, oxygen concentration sensor 52 etc. are connected to the input-output circuit 43, and based on the signal input from these driving state detectors via the input-output circuit 43 and programs, data, etc. in the ROM 41 and the RAM 42, the control system executes air-fuel ratio feedback control, fuel injection control, ignition control, fuel evaporation gas purge control, malfunction detection of the purge system 21, and the like, and as well as outputting drive signals to the fuel intake valve 16, spark plugs 53, canister closing valve 26, purge control valve 31, etc. via the input-output circuit 43, informs the driver when there is a breakdown in the purge system 21 by igniting an alarm light 53. The various controls executed by the control circuit 39 will now be explained.

Air-fuel Ratio Feedback Control

Figure 5:
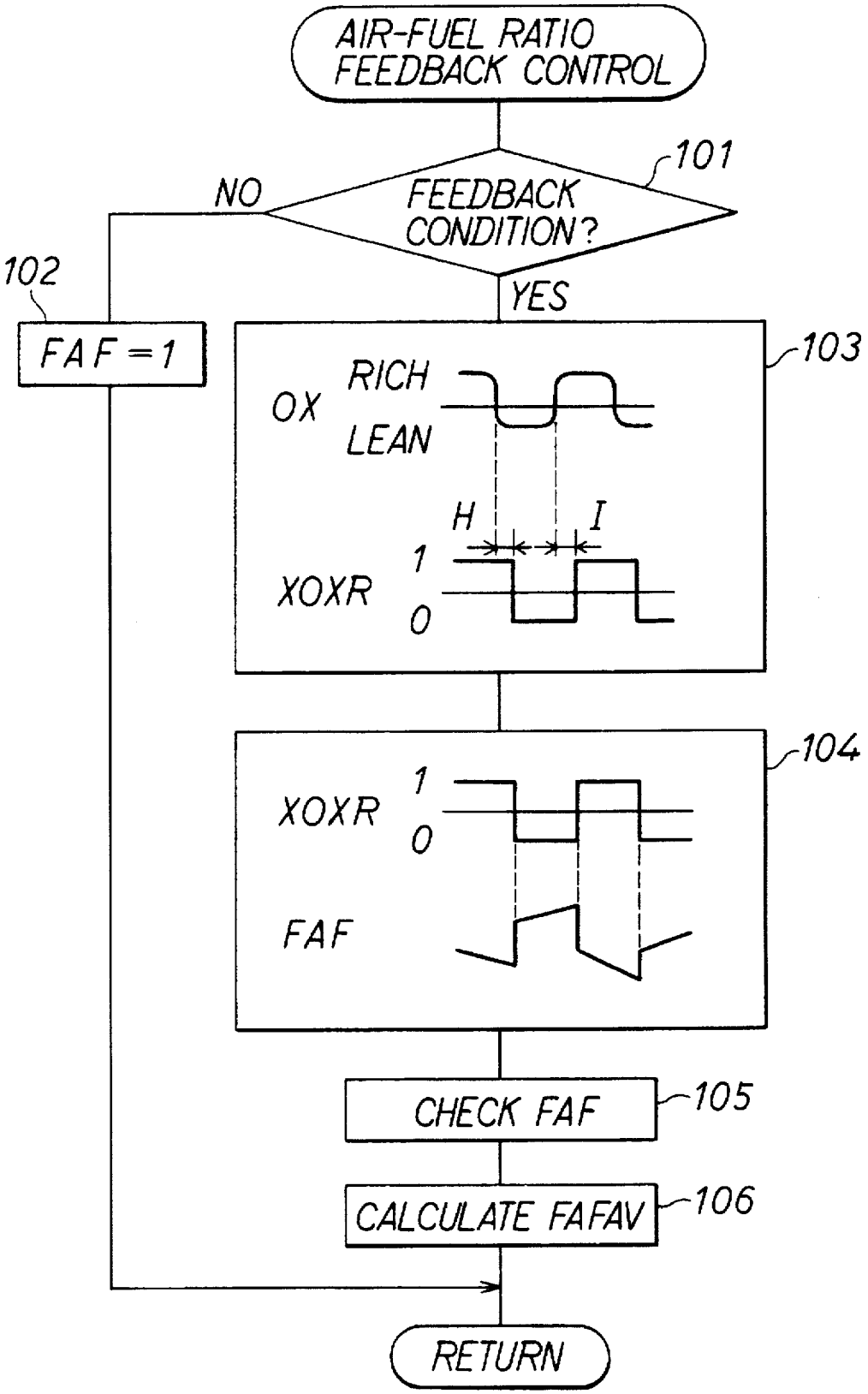
FIG. 5 is a flow chart showing the flow of processes in an air-fuel ratio feedback control routine.

The air-fuel ratio feedback control routine, in accordance with the flow chart of FIG. 5, is executed by an interruption process every 4 milliseconds for example. Upon commencement of the process of this routine, firstly in step 101 it is determined whether feedback executing conditions have been established. Here, as feedback executing conditions there are (1) not during engine start time, (2) not during fuel cut-out, (3) cooling water temperature THW≧40° C., (4) fuel injection amount TAU>TAUmin (where TAUmin is the minimum fuel injection amount of the fuel intake valve 16), (5) that the oxygen sensor 52 for detecting the oxygen concentration in the exhaust gas is an active state, and the like, and where all of these conditions (1) to (5) are satisfied, the feedback executing conditions are established. Where these feedback executing conditions have not been established, the control unit 39 (CPU 40, in particular) proceeds to step 102, sets the air-fuel ratio feedback correction coefficient FAF to 1.0 (no feedback control in effect), and concludes this routine.

On the other hand, where these feedback executing conditions are established, the control unit 39 proceeds to step 103, compares the output of the oxygen sensor 52 with a predetermined determination level, delays it only by each of predetermined time periods H and I (milliseconds) and operates an air-fuel ratio flag XOXR. Specifically, this flag is set to XOXR=0 (lean-in-fuel condition) after H (milliseconds) from when the oxygen sensor output changes from rich to lean, and is set to XOXR=1 (rich-in-fuel condition) after I (milliseconds) from when the oxygen sensor output changes from lean to rich.

In the next step 104, the value of the air-fuel ratio feedback correction coefficient FAF is operated in the following way based on the above air-fuel ratio flag XOXR. Namely, when the air-fuel ratio flag XOXR changes from "0" to "1" or from "1" to "0", the value of the air-fuel ratio feedback correction coefficient FAF skips a predetermined amount (proportional control), and when the air-fuel ratio flag XOXR continues to be "1" or "0", integration control of the air-fuel ratio feedback correction coefficient FAF is performed. Thereafter, in step 105, upper and lower limit checking (guard processing) of the air-fuel ratio feedback correction coefficient FAF value is performed, and in step 106 an averaging process is performed at every skip or every predetermined time period to calculate an average value FAFAV of the air-fuel ratio feedback correction coefficient, then the routine is concluded.

Purge Ratio Control

Figure 6:
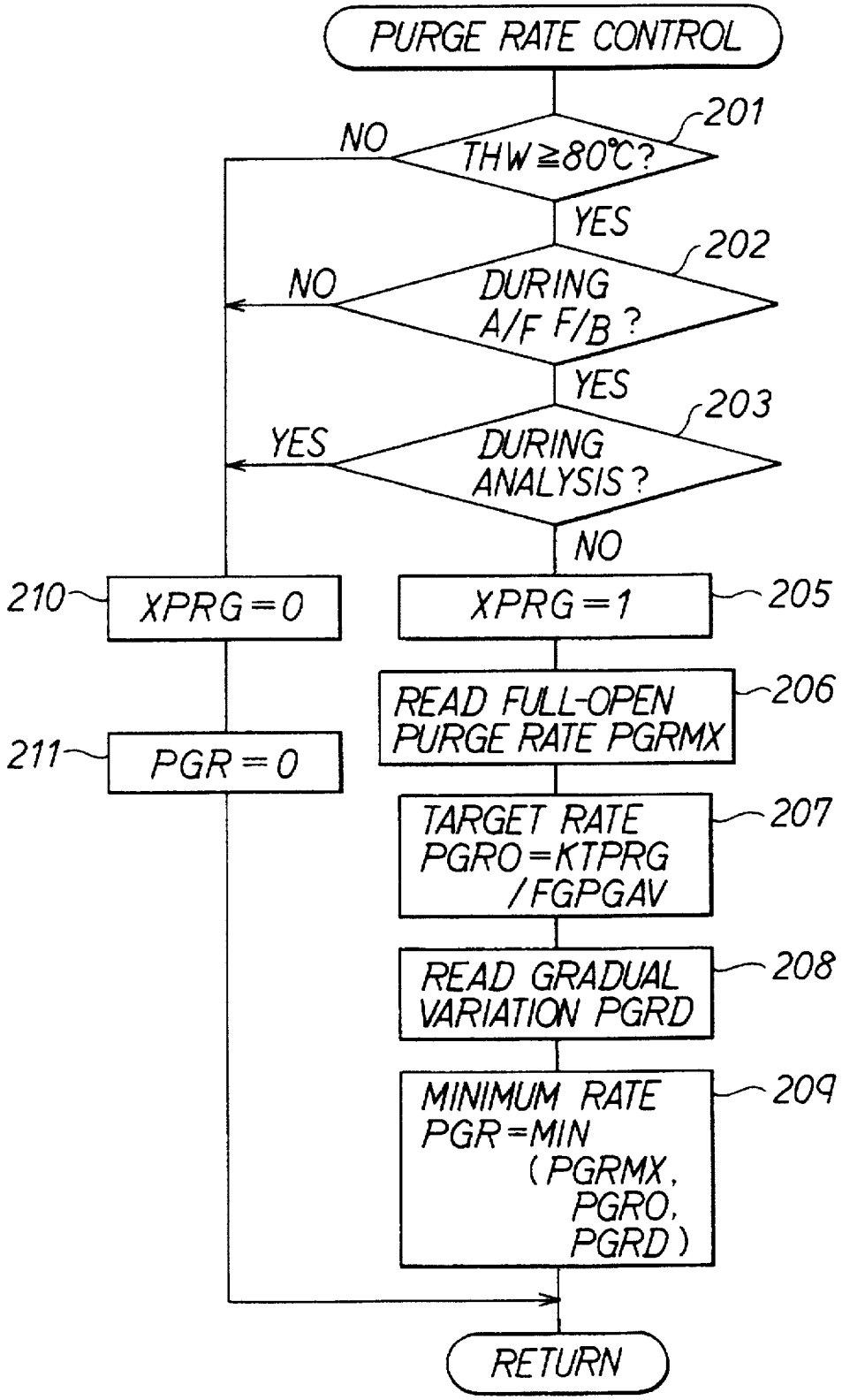
FIG. 6 is a flow chart showing the flow of processes in a purge ratio control routine.

Purge ratio control is executed by an interruption process every 32 milliseconds for example according to the flow chart of FIG. 6. Upon commencement of processing, firstly, as well as determining whether the cooling water temperature THW is 80° C. or more in step 201, the control unit 39 determines whether it is during air-fuel ratio feedback control (A/F F/B) in step 202. At this time, if it is after warming up of the engine (THW≧80° C.) and normal air-fuel ratio feedback is executed (when conditions have been established in step 101 of FIG. 4), steps 201 and 202 are both determined to be "Yes", the control unit 39 proceeds to step 203, determines whether or not breakdown analysis or malfunction detection is being executed and, if breakdown analysis is not being executed, proceeds to step 205.

In step 205, after "1" is set in a purge execution flag XPRG, a final purge ratio PGR is calculated in the following way in steps 206 to 209. Firstly, in step 206, a full-open purge ratio PGRMX is read in from the two-dimensional map of FIG. 7 based on the intake pressure Pm and engine rotations NE. Next in step 207 a target TAU correction amount KTPRG is divided by an average fuel evaporation gas density value FGPGAV to calculate a target purge ratio PGRO (i.e. PGRO=KTPRG/FGPGAV).

Here, the target TAU correction amount KTPRG corresponds to a maximum correction amount when decrease-correcting a fuel injection amount TAU. Also, the average fuel evaporation gas density value FGPGAV corresponds to a fuel evaporation gas adsorption amount into the canister 23 and is written into the RAM 42 while being estimated by a process to be described later and continually updated. Consequently, the target purge ratio PGRO corresponds to how much fuel evaporation gas may be supplemented by purging when it is presumed that the fuel injection amount is fully reduced to the target TAU correction amount KTPRG. In this case, if in the same driving state, the target purge ratio PGRO is a value small enough for the average fuel evaporation gas density value FGPGAV to be large. In the present embodiment the target TAU correction amount KTPRG is set to 30% for example.

After the target purge ratio PGRO has been calculated, in step 208 a gradual purge ratio variation value PGRD is read in. Here, gradual purge ratio variation value PGRD is a control amount provided for when an optimum air-fuel ratio cannot be maintained without over-correcting upon a sudden large change in the purge ratio, in order to avoid this. The setting method for this gradual purge ratio variation value PGRD will be explained under "Gradual Purge ratio Variation Control" described later.

When the full-open purge ratio PGRMX, target purge ratio PGRO and gradual purge ratio variation value PGRD have been obtained in this way, step 209 is proceeded to and the minimum one thereamong is set as the final purge ratio PGR. Purge control is executed by this final purge ratio PGR. In this case, normally the final purge ratio PGR is controlled by the gradual purge ratio variation value PGRD and if this gradual purge ratio variation value PGRD continues to increase the final purge ratio PGR is guarded at an upper limit by the full-open purge ratio PGRMX or the target purge ratio PGRO.

Meanwhile, when THW<80°, when not during air-fuel feedback control, or during breakdown analysis, the control unit 39 proceeds to step 210, where it clears the purge execution flag XPRG to "0", and in step 211 it resets the final purge ratio PGR to "0" then concludes the routine. Setting the final purge ratio PGR to "0" means that fuel evaporation gas purging will not be executed. Namely, where the cooling water temperature is low such as before the engine 11 is warmed up (THW<80° C.), a fuel increase other than in purging is executed due to temperature correction and purge ratio control is not executed.

Gradual Purge Ratio Variation Control

Figures 7, 8:
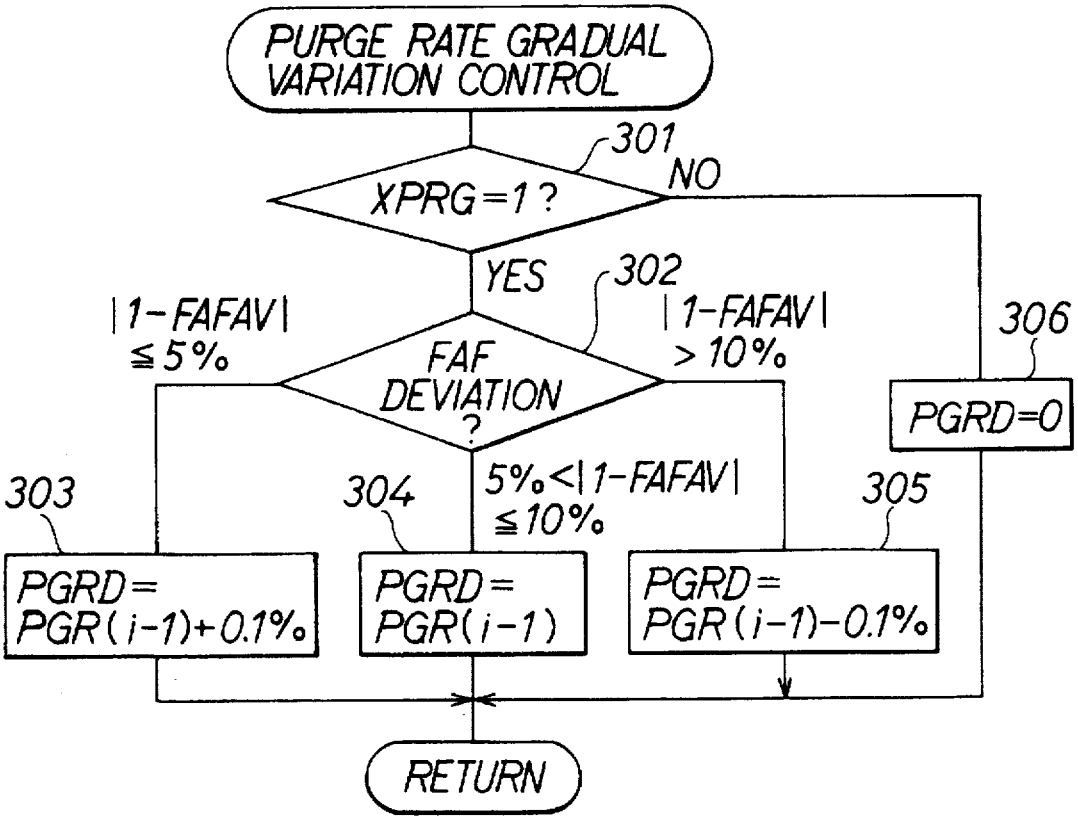
FIG. 7 is a table showing an example of a full open purge ratio map.
FIG. 8 is a flow chart showing the flow of processes in a gradual purge ratio variation control routine.

Gradual purge ratio variation control is executed by an interruption process every 32 milliseconds for example according to the flow chart of FIG. 8. Upon commencement of processing, firstly in step 301 it is determined whether the purge execution flag XPRG is "1" or not, and where the purge execution flag XPRG=0, i.e. where purge ratio control is not executed, step 306 is proceeded to where the gradual purge ratio variation value PGRD is taken as "0" then the routine is completed.

On the other hand, where XPRG=1, step 302 is proceeded to, where the change amount or deviation |1−FAFAV| of the air-fuel ratio feedback correction coefficient FAF is detected. At this time, if |1−FAFAV|≦5%, step 303 is proceeded to, where a value calculated by adding "0.1%" to the previous final purge ratio PGR(i−1) is taken as a current gradual purge ratio variation value PGRD. Also, if 5%<|1−FAFAV|≦10%, step 304 is proceeded to where the previous final purge ratio PGR(i−1) is taken as the current gradual purge ratio variation value PGRD. If |1−FAFAV|>10%, step 305 is proceeded to and a value calculated by subtracting "0.1%" from the previous final purge ratio PGR(i−1) is taken as a current gradual purge ratio variation value PGRD. Overcoming such problems by means of the gradual purge ratio variation value PGRD for when an optimum fuel-air ratio cannot be maintained upon a large change in the purge ratio without over-correcting is as described above.

Fuel Evaporation Gas Density Detection

Figure 9:
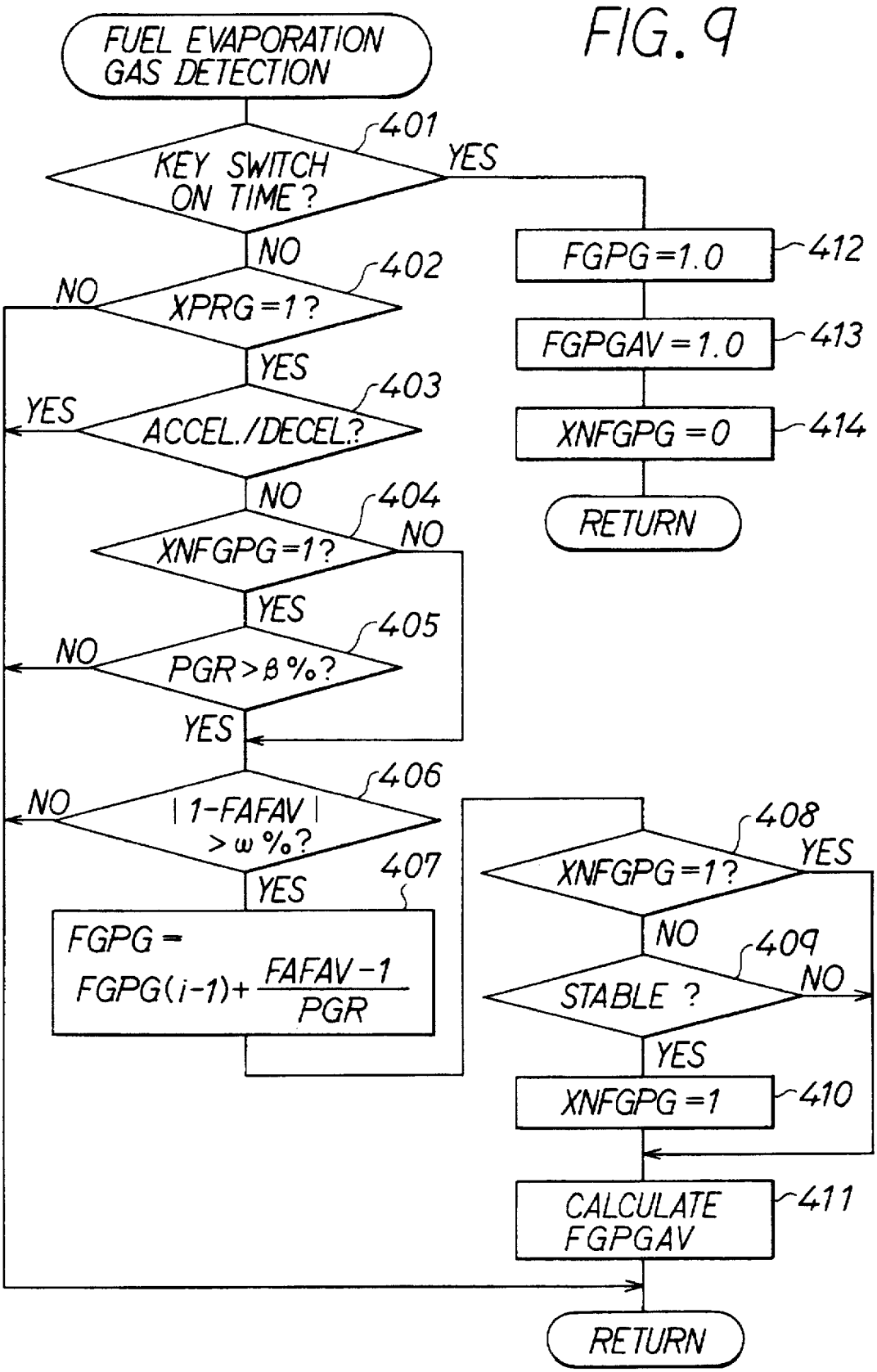
FIG. 9 is a flow chart showing the flow of processes in a fuel evaporation gas density detection routine.

Fuel evaporation gas density detection is executed by an interruption process every 4 milliseconds for example according to the flow chart of FIG. 9. Upon commencement of processing, firstly in step 401 it is determined whether a key switch has been turned on. If the key switch has been turned on, each type of data is initialized, the fuel evaporation gas density FGPG is reset to 1.0, the average fuel evaporation gas density value FGPGAV to 1.0, and an initial density detection completion flag XNFGPG to 0 in steps 412 to 414. Here, that the fuel evaporation gas density FGPG=1.0 and the average fuel evaporation gas density value FGPGAV=1.0 means that the fuel evaporation gas density is "0" (i.e. no fuel evaporation gas at all has been adsorbed in the canister 23). The absorption amount is presumed to be "0" due to initialization at engine starting. The initial density detection completion flag XNFGPG=0 means that the fuel evaporation gas density has not yet been detected after engine starting.

After the key switch has been turned on, step 402 is proceeded to and it is determined whether or not the purge execution flag XPRG is "1", namely whether or not purge control has commenced. Here, where XPRG≠1 (before commencement of purge control), the routine finishes in that state. On the other hand, where XPRG=1 (after commencement of purge control), step 403 is proceeded to and it is determined whether or not the vehicle is accelerating or decelerating. Here, the determination as to whether the vehicle is accelerating or decelerating is performed by detection results of the idle switch 46 being off, opening changes of the throttle valve 14, intake pressure changes, vehicle speed changes and the like. Then, when it is determined that the vehicle is accelerating or decelerating, the routine is completed as is. Namely, during acceleration or deceleration (transient state of engine operation) fuel evaporation gas density detection is prohibited thereby to prevent erroneous detection of evaporation gas concentration.

Also in step 403, where it is determined that the vehicle is not accelerating or decelerating, step 404 is proceeded to and it is determined whether the initial density detection completion flag XNFGPG is "1", namely whether initial detection of the fuel evaporation gas density is completed. Here, if XNFGPG=1 (after initial detection) step 405 is proceeded to, and if XNFGPG=0 (before initial detection) step 405 is bypassed and step 406 is proceeded to.

Firstly, since fuel evaporation gas density detection has not been completed (XNFGPG=0), the control unit 39 proceeds from step 404 to step 406, and it is determined whether or not the average value FAFAV of the air-fuel ratio feedback correction coefficient has a deviation of more than a predetermined value ω (for example 2%) with respect to a reference value (=1). Namely, where the change amount of the air-fuel ratio due to fuel evaporation gas purging is too small, the fuel evaporation gas density cannot be correctly detected. Therefore, if the change amount of the air-fuel ratio is small (|1−FAFAV|≦ω), the routine is completed as is. Also, if the change amount of the air-fuel ratio is large (|1−FAFAV|>ω), step 407 is proceeded to and the fuel evaporation gas density FGPG is detected by the following equation (1).

$$FGPG=FGPG(i-1)+(FAFAV-1)/PGR \quad (1)$$

In the above equation, the initial value of the fuel evaporation gas density FGPG as described above is "1" and is gradually updated according to whether the air-fuel ratio is toward rich or toward lean. In this case, the value of the fuel evaporation gas density FGPG is decreased to the standard or referece "1" as the actual fuel evaporation gas density increases (the adsorption amount of the canister 23 increases). Also, the value of the fuel evaporation gas density FGPG is increased according to the amount by which the actual fuel evaporation gas density has decreased (the purge amount of the canister 23). Specifically, where the air-fuel ratio is rich (FAFAV−1<0), the value of fuel evaporation gas density FGPG decreases only by a value calculated by dividing "FAFAV−1" by the final purge ratio PGR. Alternatively, where the air-fuel ratio is lean (FAFAV−1>0), the value of fuel evaporation gas density FGPG increases only by a value calculated by dividing "FAFAV−1" by the final purge ratio PGR.

Thereafter, step 408 is proceeded to and it is determined whether the initial density detection completion flag XNF- GPG is "1". Here, where XNFGPG=0, step 409 is proceeded to and it is determined whether the fuel evaporation gas density FGPG is stable or not depending on whether a state in which variations in a previous detection value and a current detection value of fuel evaporation gas density FGPG are less than a predetermined value (e.g. 3%) has repeated more than three times. Upon the fuel evaporation gas density FGPG becoming stable, the next step 410 is proceeded to and after setting the initial density detection completion flag XNFGPG to "1", the process proceeds to step 411.

Meanwhile, where XNFGPG=1 in the above step 408, or where it is determined that the fuel evaporation gas density FGPG has not stabilized in the step 409, the process jumps to step 411 and in order to average the current fuel evaporation gas density FGPG, a predetermined averaging calculation (e.g. 1/64 averaging calculation) is executed and a fuel evaporation gas density average value FGPGAV is obtained.

Upon completion of initial evaporation gas density detection in this way (upon setting of XNFGPG=1), step 404 has already determined "Yes", and the process proceeds to step 405, where it is determined whether the final purge ratio PGR exceeds a predetermined value β (e.g. 0%). Then, only where PGR>β, fuel evaporation gas density detection from step 406 onward is executed. Namely, the final purge ratio PGR is made "0" even where the purge execution flag XPRG has been set and in actuality evaporation purging has not been executed. Therefore, at times other than initial detection, detection of the fuel evaporation gas density is not carried out where PGR=0.

It is to be noted that where the final purge ratio PGR is small, i.e. where the purge control valve 31 is controlled toward a low flow amount, the precision of opening control is relatively low and the reliability of fuel evaporation gas density detection is low. Here, at times other than when the predetermined value β of step 405 is set in a low opening range of the purge control valve 31 (e.g. 0%<β<2%) and during initial detection, fuel evaporation gas density detection may be performed only where precise detecting conditions are present.

Fuel Injection Amount Control

Figure 10:
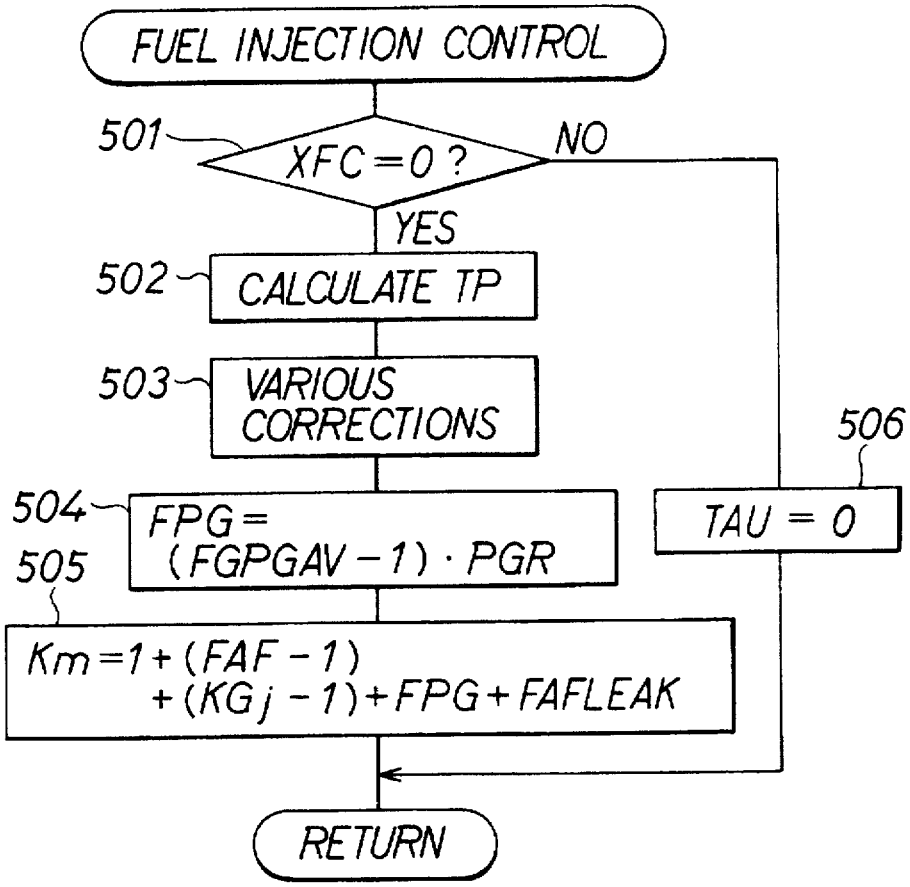
FIG. 10 is a flow chart showing the flow of processes in a fuel injection amount control routine.

Fuel injection amount control is executed by an interruption process every 4 milliseconds, for example, according to the flow chart of FIG. 10. Upon commencement of processing, firstly in step 501 it is determined whether a fuel cut-off flag XFC is "0" which indicates non-execution of fuel cut-off at vehicle or engine deceleration, and if XFC=1 (fuel cut-off execution) the process proceeds to step 506, the fuel injection amount TAU is set to "0" and the routine is completed. A fuel cut-off is thereby executed.

On the other hand, if XFC=0 (fuel cut-off non-execution), the process proceeds to step 502 and a basic fuel injection amount TP which corresponds to the engine revolutions NE and load (e.g. intake pipe pressure PM) is calculated based upon data mapped and stored in the ROM 41. Then, in the next step 503 various types of basic corrections relating to the drive state of the engine 11 (cooling water temperature correction, post-start corrections, intake temperature correction, etc.) are performed. Thereafter, in step 504, a purge correction coefficient FPG is calculated by means of the following equation (2) according to the fuel evaporation gas density average value FGPGAV calculated in the routine of FIG. 9 and the final purge ratio PGR calculated in the routine of FIG. 6.

$$FPG=(FGPGAV-1)\cdot PGR \quad (2)$$

This purge correction coefficient FPG means a fuel amount supplemented by execution of purging under conditions determined by the purge ratio control process, and an amount corresponding to this coefficient is subtraction-corrected from the basic injection amount TP.

Thereafter, in step 505, a correction coefficient Km is obtained by means of the following equation (3) from the air-fuel ratio feedback correction coefficient FAF, the purge correction coefficient FPG and a air-fuel ratio learning value KGj, and this correction coefficient Km is multiplied by the basic injection amount TP and reflected in the fuel injection amount TAU.

$$Km=1+(FAF-1)+(KGj-1)+FPG+FAFLEAK \quad (3)$$

Here, FAFLEAK is a fuel injection amount correction value calculated by a process described later and shown in FIG. 19 and FIG. 23. Also, the air-fuel ratio learning value KGj is a back-up data memorized and held in the RAM 42, and is a coefficient set for each engine drive range. Also, the control unit 39 (particularly CPU 40) executes fuel injection by means of the fuel injection valve 16 based on the fuel injection amount TAU at predetermined fuel injection timings.

Control of Purge Control Valve

Figure 11:
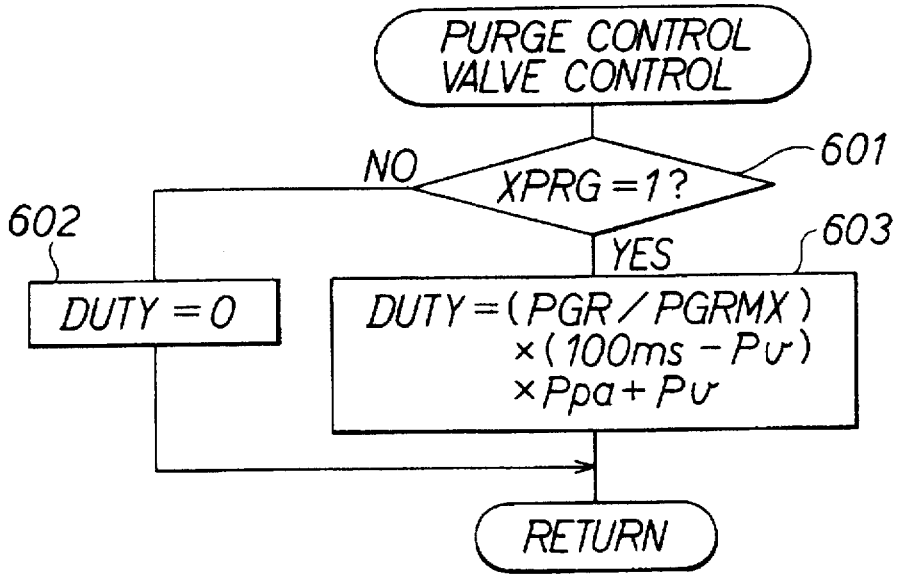
FIG. 11 is a flow chart showing the flow of processes in a purge control valve control routine.

Control of the purge control valve 31 is executed by an interruption process every 100 milliseconds, for example, according to the flow chart of FIG. 11. Upon commencement of processing, firstly in step 601 it is determined whether the purge execution flag XPRG is "1", indicating purge execution, and if XPRG=0 (purge not executed), the process proceeds to step 602, where the control value DUTY for driving the purge control valve 31 is made "0". Also, if XPRG=1 (purge execution), step 603 is proceeded to, where the control value DUTY is calculated by means of the following equation (4), based on the final purge ratio PGR and the full-open purge ratio PGRMX which corresponds to the driving state at that time.

$$DUTY=(PGR/PGRMX)\cdot(100-Pv)\cdot Ppa+Pv \quad (4)$$

With this equation, the drive cycle of the purge control valve 31 is set at 100 milliseconds. Also, Pv is a voltage correction value with respect to fluctuations in battery voltage (time equivalence amount for drive cycle correction) and Ppa is an atmospheric pressure correction value with respect to fluctuations in atmospheric pressure. Based on the control value DUTY calculated by the above equation (4), the DUTY ratio of the drive pulse signal of the purge control valve 31 is set.

Breakdown Analysis

Figure 12:
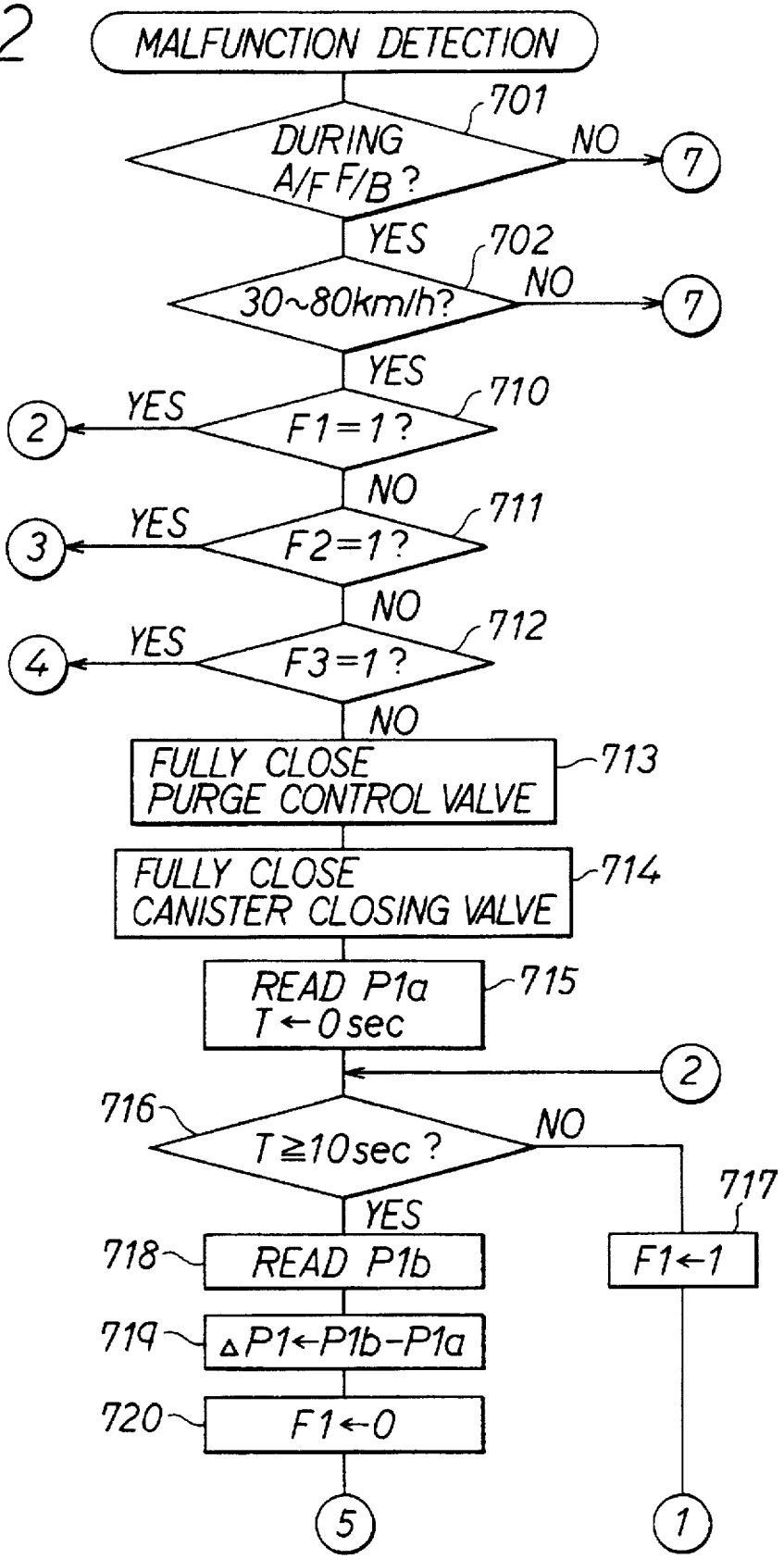
FIG. 12 is a flow chart showing a part of the flow of processes in a breakdown analysis routine.
Figure 13:
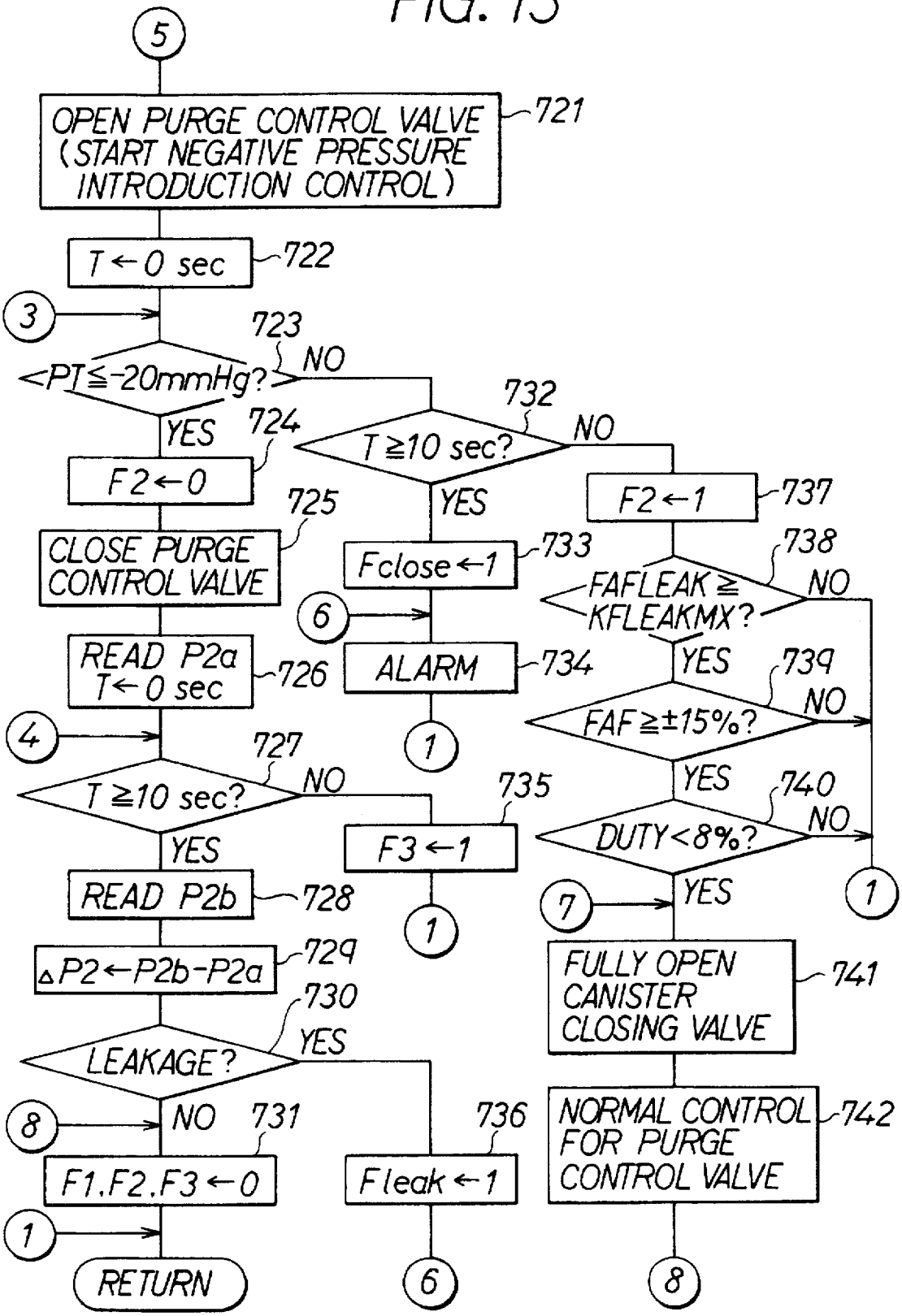
FIG. 13 is the other part of the flow chart showing the flow of processes in a breakdown analysis routine.

Breakdown analysis or malfunction detection of the purge system 21 is repeatedly executed at predetermined intervals (e.g. every 256 milliseconds) according to the flow charts of FIGS. 12 and 13 when the key switch (not shown in the drawing) is turned on.

Upon commencement of the process of this routine, firstly in steps 701 and 702 of FIG. 12 it is determined whether the condition of the engine is stable or not. Namely, in step 701 it is determined whether air-fuel feedback control is being executed, and then in step 702 it is determined whether the vehicle speed is between 30 and 80 km/h. If "Yes" has been determined in both steps 701 and 702, the process proceeds to step 710, but if either are determined as "No", breakdown analysis is prohibited, the process advances to step 741 of FIG. 13, the canister closing valve 26 is fully opened, step 742 is proceeded to, and after the purge control valve 31 has been placed in a normal control state, step 731 is proceeded to, first to third flags F1, F2 and F3 are reset to "0" and the routine is completed.

Meanwhile, where "Yes" has been determined in both steps 701 and 702, the process advances to steps 710 to 712 of FIG. 12, where it branches off into various steps while determining to what stage the current process is advancing. The process has four stages 1 to 4, and the process stage can be determined from the setting states of first to third flags F1 to F3. When all of the flags F1 to F3 are set at "0", namely when steps 710 to 712 are "No", this is the first stage and step 713 is proceeded to.

In the first stage, after the purge control valve 31 has firstly been fully closed in step 713, in step 714 the canister closing valve 26 is fully closed and the purge passage from the fuel tank 17 to the intake pipe 12 is placed in a closed state. Namely, as shown in FIG. 14, by first of all fully closing the purge control valve 31 at a time T1 when the canister closing valve 26 is in an open state, the purge passage from the fuel tank 17 to the purge control valve 31 is maintained at the same pressure as the atmosphere through the outside connecting hole 25, and by fully closing the canister closing valve 26 at a slightly delayed time T2, a closed purge passage maintained at atmospheric pressure is formed.

Figures 14A, 14B, 14C:
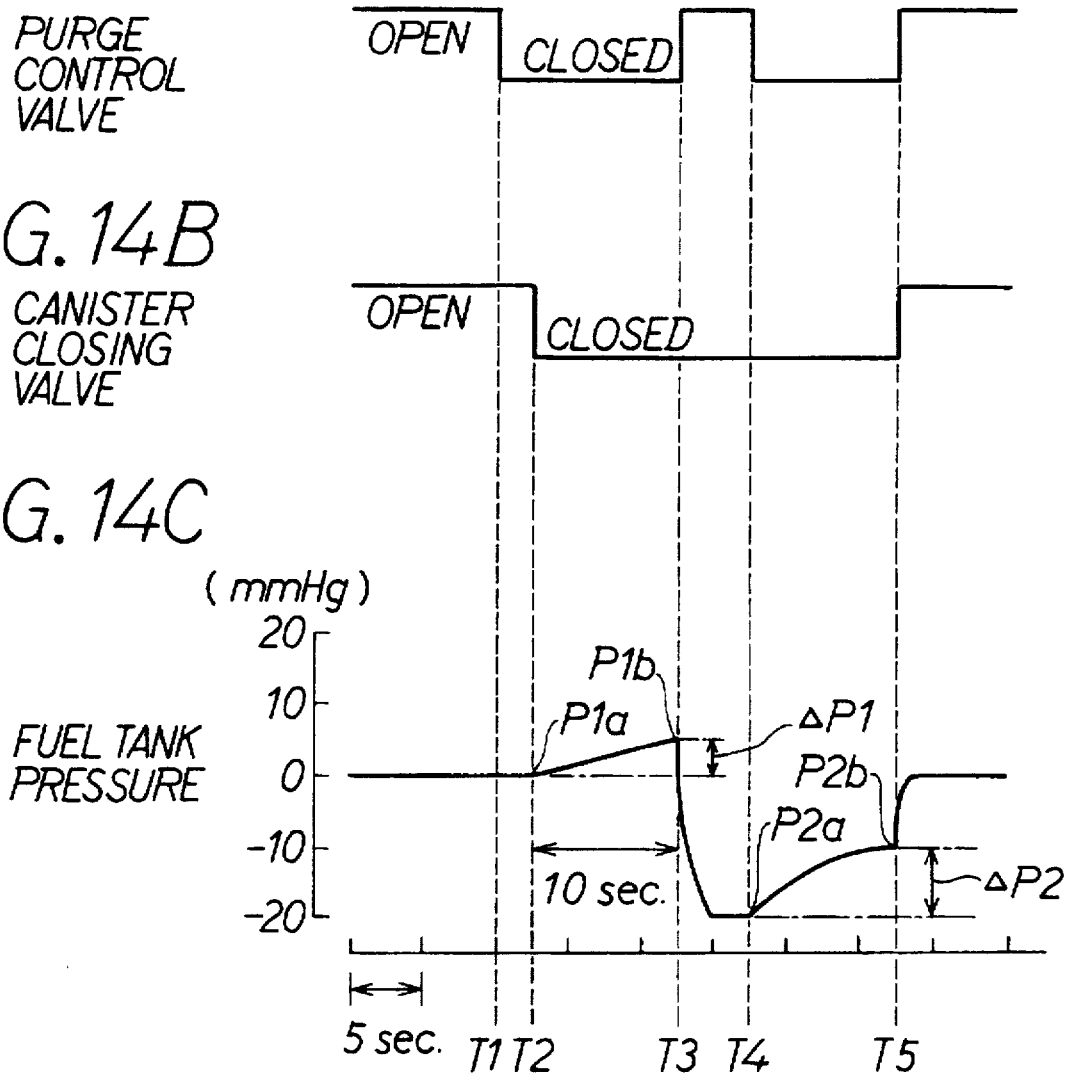
FIGS. 14A, 14B and 14C are time charts illustrating the relationship between the opening/closing of the purge control valve and the canister closing valve during breakdown analysis and variations in the fuel tank internal pressure.

Then, in the next step 715, the fuel tank internal pressure P1*a* at time T2 shown in FIG. 14 is read, and after a timer T is reset and started, step 716 is proceeded to, where it is determined whether the count value of the timer T is 10 seconds or more. If less than 10 seconds, step 717 is proceeded to, the first flag F1 is set at "1", and the routine is finished.

In the second stage, "Yes" is determined in step 710, and the process is repeated from steps 701 to 710 to steps 716 onward. The detection value of the pressure sensor 20 during this period increases from 0 mmHg according to the amount of fuel evaporation gas generated in the fuel tank 17 during the interval from the time T2 to a time T3 in FIG. 14.

Thereafter, upon a lapse of 10 seconds from the time T2 (time of detection of P1*a*), the process advances to step 718 of FIG. 13, an input signal from the pressure sensor 20 is read in, the fuel tank internal pressure P1*b* at that time is memorized, and subsequently, after a ten second interval pressure fluctuation amount ΔP1 is calculated in step 719, the first flag F1 is reset in step 720. The second stage process is thereby concluded and the third stage process begun.

In the third stage, firstly, at the same time that the purge control valve 31 is switched from a fully closed state to a fully open state and negative pressure introduction control is commenced in step 721, the timer T is reset and started in step 722. Here, because the purge control valve 31 is fully opened, intake pipe negative pressure commences to be introduced into the closed purge passage under atmospheric pressure prior thereto (time T3 in FIG. 14). Consequently, if there are no abnormalities such as pressure leakage in the purge path or the like, the detection value of the pressure sensor 20 begins to drop.

In the next step 723, it is determined whether the fuel tank internal pressure PT is −20 mmHg relative to the atmospheric pressure based on an input signal from the pressure sensor 20, and if PT>−20 mmHg the process advances to step 732, where it is determined whether 10 seconds have passed from when the purge control valve 31 has been fully opened. If less than 10 seconds have passed, step 737 is proceeded to and the second flag F2 is set at "1". Thereafter, in steps 738 to 740, whether introduction of intake pipe negative pressure to the purge system 21 is being performed in a stable state or not is determined. Specifically, firstly in step 738 it is determined whether a fuel injection amount correction value FAFLEAK is more than an upper limit guard value KFLEAKMX, and if FAFLEAK≧KFLEAKMX, the process advances to step 739, where whether the air-fuel ratio feedback correction coefficient FAF is ±15% is determined. Then, if FAF≧±15%, step 740 is proceeded to and whether the control value DUTY for driving the purge control valve 31 is less than 8% is determined.

Where the determinations in all of these steps 738 to 740 are "Yes", i.e. where introduction of intake pipe negative pressure is unstable, breakdown analysis is prohibited, the canister closing valve 26 is fully opened (step 741), the purge control valve 31 is placed in a normal control state (step 742), the first to third flags F1, F2 and F3 are reset to "0" (step 731) and the process is completed. On the other hand, where any one of the steps 738 to 740 is determined to be "No", i.e. where the fuel injection amount correction value FAFLEAK is less than the upper limit guard value KFLEAKMX, where the air-fuel ratio feedback correction coefficient FAF is less than ±15%, or where the control value DUTY for driving the purge control valve 31 is more than 8%, introduction of the intake pipe negative pressure is stable and the routine is concluded.

It is to be noted that where the negative pressure introduction valve opening control is performed by the final purge ratio PGR rather than by the control value DUTY, the determination process of step 740 is changed to "PGR<0.2%", and where PGR<0.2%, the breakdown analysis may be prohibited.

In the previously described step 737, upon the second flag F2 being set to "1", when the routine is executed from the next time onward, "No" is determined in step 710 and "Yes" is determined in step 711, and the process is repeated from steps 701 to 711 to step 723 onward. This state is concluded upon step 723 or step 732 becoming "Yes". Where step 732 becomes "Yes" first, this means that there is a blocked section somewhere in the purge passage from the fuel tank 17 to the intake valve 12 and, in step 733, a purge system shutdown flag Fclose is set to "1", then in step 734 the alarm light 53 is illuminated.

Meanwhile, if step 723 becomes "Yes" first, step 724 is proceeded to and the second flag F2 is reset, then the purge control valve 31 is again fully closed in step 725, after which in step 726, as well as an input signal being read in from the pressure sensor 20 and the fuel tank internal pressure P2*a* being stored immediately after the purge path has reached a negative pressure closed or sealed state, the timer T is reset and started. Thereby, the process moves from the third stage to the fourth stage.

By execution of the processes of steps 724 to 726 described above, as shown in FIG. 14 the interior of the closed purge passage is placed in a state adjusted to a negative pressure of −20 mmHg at time T4. Thereafter, the detection value of the pressure sensor 20 increases from −20 mmHg according to the amount of fuel evaporation gas generated within the fuel tank 17 between times T4 and T5.

Then, in step 727 it is determined whether 10 seconds has passed after P2*a* has been read in, and if prior to 10 seconds, step 735 is proceeded to, the third flag F3 is set to "1" and the routine is concluded. Thereby, when this routine is executed from the next time onward, "No" is determined in steps 710 and 711 and "Yes" in step 712, and the processes of steps 701 to 712 and 727 onward are repeated.

Thereafter, upon a lapse of 10 seconds from the reading in of P2*a*, step 728 is proceeded to, where the input signal from the pressure sensor 20 is read in, the fuel tank internal pressure P2*b* at time T5 is memorized and a pressure fluctuation amount ΔP2 (=P2*b*−P2*a*) in a ten-second interval after the closure of evaporation gas passage is calculated. After this, in step 730 it is determined whether there is a leak based on the leakage determination condition shown in the following equation (5).

$$\Delta P2>A=\Delta P1+B \quad (5)$$

Here, A is a coefficient for correcting a difference in the fuel evaporation gas amount due to a difference between the atmospheric pressure and the negative pressure and B is a coefficient for correcting the detection precision of the pressure sensor 20, pressure leakage in the canister closing valve 26, etc. If the above equation (5) is satisfied, it is determined that "leak exists". Namely, if there is cause for a leak in the sealed or closed space from the fuel tank 17 to the purge control valve 31, while outflow from the sealed space to the atmosphere occurs under positive pressure, inflow of air from the atmosphere into the closed space occurs under negative pressure. Consequently, "(pressure fluctuation amount ΔP2 under negative pressure)=(amount of fuel evaporation gas generated from fuel tank 17)+(inflow amount from atmosphere into closed space)" is larger than "(pressure fluctuation amount ΔP1 under atmospheric pressure)=(amount of fuel evaporation gas generated from fuel tank 17)−(outflow amount from closed space into atmosphere)". The leakage determination condition of equation (5) is derived from this relationship.

Where the leakage determination condition of equation (5) is satisfied, i.e. where "leak exists" is determined in step 730, this means that there is a section somewhere in the purge passage from the fuel tank 17 to the intake valve 12 which is causing a leak, and in step 736, a purge passage leak flag Fleak is set to "1", then in step 734 the alarm light is illuminated. On the other hand, where "No" is determined in step 730, i.e. where a leak is not present, step 731 is proceeded to and the first to fourth flags F1 to F4 are forcibly reset and the routine concluded.

The various abnormal states which can be detected by the breakdown analysis process explained above are as follows.

Case (1): Damage/drop-off of Connecting Line 22 or Purge Passage 30*a*

Since there is inflow of atmosphere from damage or drop-off portions under negative pressure and outflow into the atmosphere under positive pressure, it can be determined in step 730 that "leak exists" and notification of the abnormality given.

Case (2): Bending, Breakage, etc. in Connecting Line 22 or Purge Passage 30*a*

Because a non-drop in pressure or a drop in pressure is delayed when negative pressure is introduced, step 723 becomes "No" and step 732 becomes "Yes", and notification of the abnormality can be given.

Case (3): Inability to Open Purge Control Valve 31

When introduction of negative pressure cannot be performed, step 723 becomes "No" and step 732 becomes "Yes" in the same way as in case (2), and notification of the abnormality can be given. Upon the purge control valve 31 not being able to open, the fuel evaporation gas adsorbed in the adsorbent 24 in the canister 23 cannot be introduced into the intake pipe 12, and thereafter the fuel evaporation gas absorption capability of the adsorbent 24 is exceeded and fuel evaporation gas escapes from the outside connecting line 25.

Case (4): Drop-off of Purge Passage 30*b*

When introduction of negative pressure cannot be performed, step 723 becomes "No" and step 732 becomes "Yes" in the same way as in cases (2) and (3), and abnormality notification can be given. It is to be noted that since case (4) is drop-off rather than closure, it can be mistaken as a type of abnormality, though even as an abnormality it can be suitably determined and the objective of the breakdown analysis is fully achieved.

Case (5): Bending, Breakage, etc. in Purge Passage 30*b*

This case is completely the same as cases (2) and (3), step 723 becoming "No" and step 732 becoming "Yes" based on the condition of negative pressure introduction, and notification of the abnormality can be given. The state of this case (5) similarly to case (3) has the possibility that fuel evaporation gas escapes from the outside connecting line 25, and thus is an abnormality requiring detection.

Case (6): Closure of Outside Connecting Line 25 of Canister 23

This abnormality is similar to breakage or bending of a rubber hose, but is not caused by a large scale pressure drop. This is because, although purging of the fuel evaporation gas cannot be performed even when the purge control valve 31 is open in the case of breakage etc. of the purge passages 30, the fuel evaporation gas can be somewhat purged when the purge control valve is open even if the outside connecting line 25 of the canister 23 is closed. Therefore, with regard to abnormalities where the outside connecting line 25 of the canister 23 is in a closed state, although they cannot be detected in the above breakdown analysis routine this is not a major problem. If necessary, in step 728 of the above breakdown analysis routine, the canister closing valve 26 may be opened immediately upon detection of the fuel tank internal pressure P2*b* and the existence of a closure abnormality of the outside connecting line 25 determined where pressure does not rapidly return to the approximately atmospheric pressure.

Case (7): State where Purge Control Valve 31 is Unable to Close

Where this abnormality exists, although there is continuous introduction of the fuel evaporation gas into the intake pipe 12, secondarily this does not cause discharge of fuel evaporation gas from the outside connecting hole 25 as in the case of an inability to open, and from the viewpoint of its preventing evaporation of the fuel evaporation gas need not be considered an abnormality. Consequently, in the above breakdown analysis routine a practice especially for detecting this abnormality has not been provided. If necessary, where ΔP1 calculated in step 719 is below a predetermined negative pressure, a determination that the purge control valve 31 is unable to close may be given.

Case (8): State Where There is Damage Such as Cracks in the Purge Passage 30*b*

Since the purge passage **30*b* is a section through which the fuel evaporation gas passes only when the purge control valve 31 has been opened, even if there are cracks or holes in it, it merely acts in the same way as the outside connecting hole 25 of the canister 23**, and from the viewpoint of its preventing evaporation of the fuel evaporation gas need not be especially considered an abnormality. Consequently, in the above breakdown analysis routine, although this cannot be detected, there are no problems whatsoever.

It is to be noted that the above cases (1) to (8) could be said to overlap in terms of being able to determine abnormalities based on the pressure fluctuation state of the pressure the sealed space either after or during adjustment to a predetermined pressure.

Figure 15:
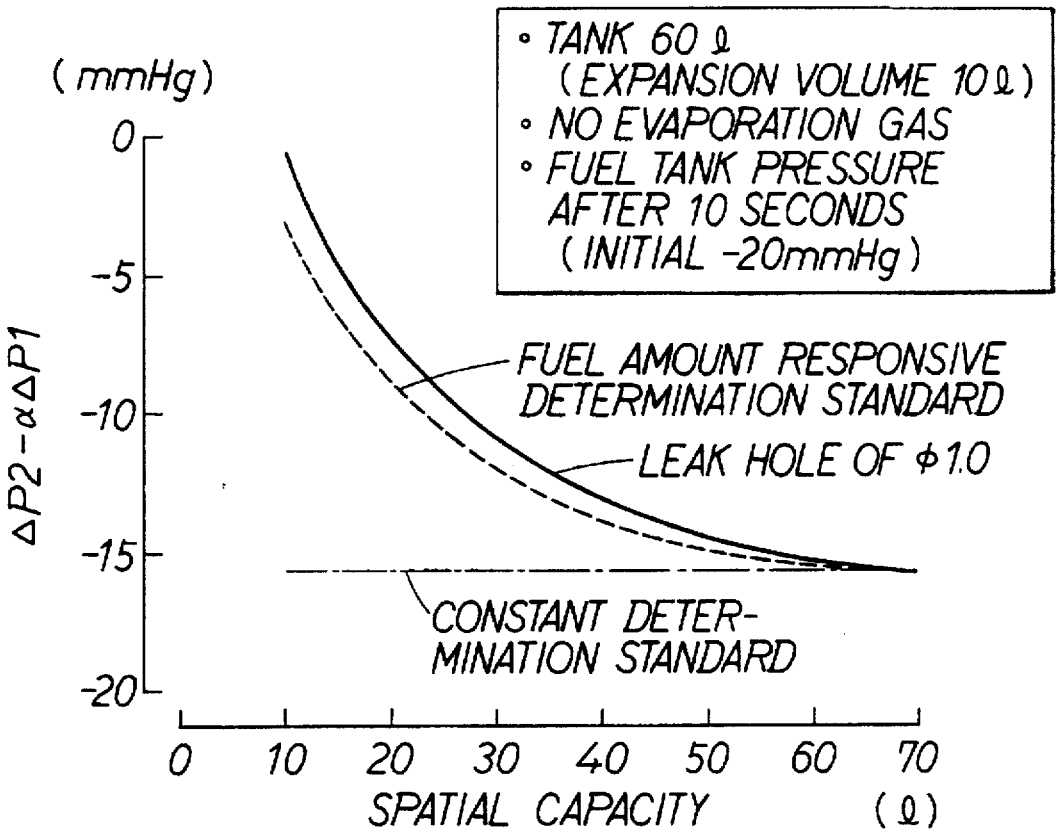
FIG. 15 is a graph showing the characteristics of variations in the spatial capacity and internal pressure of the fuel tank.

Also, in step 730, although the leak determination standard is determined irrespective of the remaining fuel amount in the fuel tank 17, as shown by the solid line in FIG. 15, even if the diameter of the leak in the closed space from the fuel tank 17 to the purge control valve 31 is constant, the remaining fuel amount changes due to the spatial capacity in the fuel tank 17 and the internal pressure fluctuation amount of the fuel tank 17 will vary greatly due to the remaining fuel amount. As a result, although a supply abnormality is detected with a large spatial capacity of a fuel tank 17 having minimum pressure fluctuation (low remaining fuel amount) as a standard, if so, when the spatial capacity of the fuel tank 17 is low (remaining fuel amount is high) this is oversensitive abnormality detection as in the case of pressure fluctuation where the diameter of a leak hole is small and which up till now has not been considered an abnormality.

Figure 16:
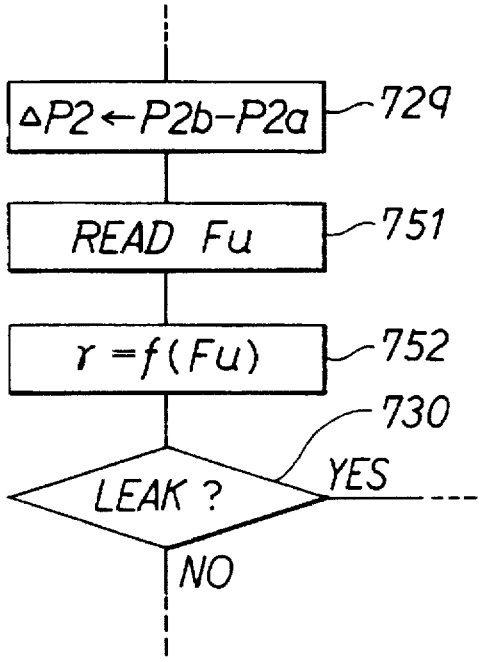
FIG. 16 is a flow chart showing the flow of major processes in a breakdown analysis routine in another embodiment of the present invention.

The leak determination standard is capable of precise determination by varying in response to the remaining fuel amount as shown by the broken line in FIG. 15. In order to perform this type of control, steps 751 and 752 of FIG. 16 are added between steps 729 and 730. Namely, in step 751, a remaining fuel amount Fu in the fuel tank is read by the output of a fuel sensor (not shown) and in step 752 a correction coefficient $\gamma$ previously set according to the remaining fuel amount Fu and corresponding to the spatial capacity of the fuel tank 17 is obtained. Then, in the next step 730, the existence of a leak is determined by the following equation (6).

$$\Delta P2 > a \cdot \Delta P1 + b + \gamma \quad (6)$$

Here, the variation characteristic of the correction coefficient $\gamma$ is set so that the determination standard as shown by the broken line in FIG. 16 varies according to a variation in the spatial capacity of the fuel tank 17 and so that the correction coefficient $\gamma$ increases as the spatial capacity of the fuel tank becomes smaller. If the above equation (6) is satisfied, it is determined in step 730 that a "leak exists".

Purge Control Valve Negative Pressure Introduction Valve Opening Control in the Case of DUTY Control Next, negative pressure introduction valve opening control of the purge control valve 31 will be explained based on FIG. 17. In this negative pressure introduction valve opening control, the control value DUTY for driving the purge control valve 31 gradually increases toward the upper limit guard value of 30% until the fuel injection amount correction value FAFLEAK reaches the upper limit guard value KFLEAKMX. Specifically, in step 801 it is determined whether the second flag F2 is "1", and if F2=1 (negative pressure introduction valve is open at times T3 to T4 in FIG. 14), in step 802 it is determined whether the fuel injection amount correction value FAFLEAK is lower than the upper limit guard value KFLEAKMX, and if FAFLEAK<KFLEAKMX, step 803 is proceeded to where the control value DUTY is raised 0.1%, then in step 804 the control value DUTy is guard processed to below the upper limit guard value of 30%. Meanwhile, in step 802, where FAFLEAK≧KFLEAKMX, step 806 is proceeded to and the control value DUTY is lowered 0.1%.

Thereafter, upon completion of negative pressure introduction at time T4 in FIG. 14, the second flag F2 is reset to "0". Thereby, steps 801 to 805 are proceeded, the control value DUTY is set to 0% and the purge control valve 31 is fully closed.

Error Correction Coefficient K1 Update Process

Figure 18:
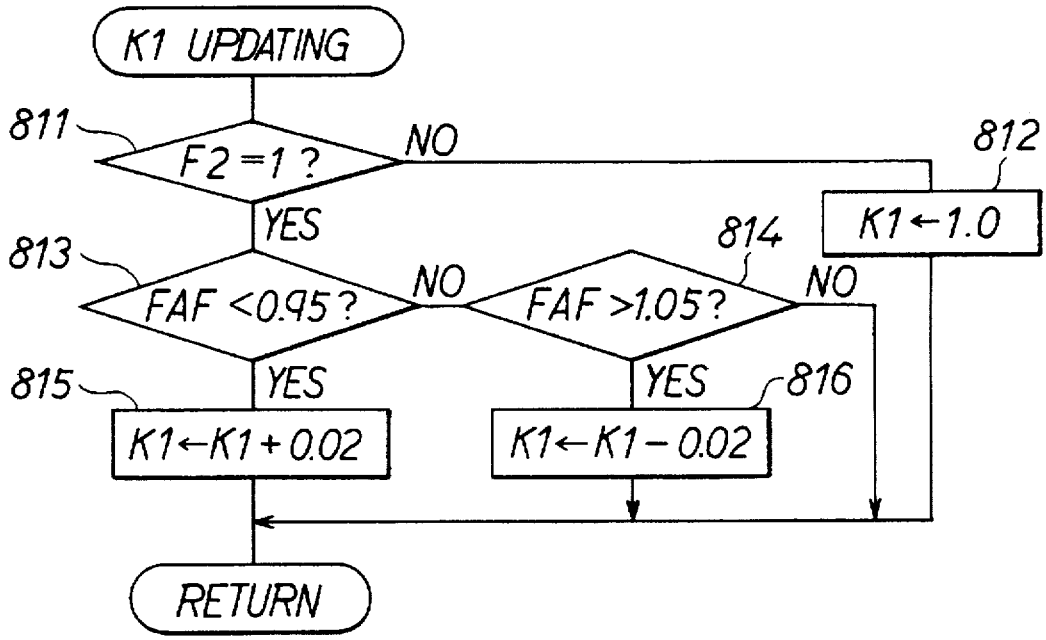
FIG. 18 is a flow chart showing the flow of an error correction coefficient K1 update process.

Meanwhile, the K1 update process of FIG. 18 is a process for updating an error correction coefficient K1 for correcting errors arising from closure of the outside connecting hole 25 of the canister 23 by the canister closing valve 26 during introduction of intake pipe negative pressure into the purge system 21, based on a deviation in the air-fuel ratio feedback correction coefficient FAF.

In this K1 updating process, firstly in step 811 it is determined whether the second flag F2 is "1" or not, and where F2=1 (negative pressure introduction valve is open at times T3 to T4 in FIG. 14), step 813 is proceeded to, where it is determined whether the air-fuel ratio feedback correction coefficient FAF is lower than 0.95 and if FAF<0.95 step 815 is proceeded to and the error correction coefficient K1 is increased by 0.02, whereas if FAF≧0.95 step 814 is proceeded to and it is determined whether FAF>1.05 and if so step 816 is proceeded to and the error correction coefficient K1 is reduced by 0.02. Also, where 0.95≦FAF≦1.05, the error correction coefficient K1 is maintained at its current value.

Thereafter, upon completion of negative pressure introduction at time T4 in FIG. 14 and resetting of the second flag F2 to "0", steps 811 to 812 are proceeded to, the error correction coefficient K1 is set to 1.0, and the process is completed.

Fuel Injection Amount Correction in the Case of DUTY Control

Next, the fuel injection amount correction routine will be explained based on FIG. 19. This routine is executed by an interruption process every 4 milliseconds for example. Upon commencement of processing, firstly in step 821 it is determined whether the second flag F2 is "1" and where F2=1 (negative pressure introduction valve is open at times T3 to T4 in FIG. 14), step 822 is proceeded to and the control value DUTY for setting the opening amount of the purge control valve 31 is read in, then in step 823 the purge flow amount GPG is read from the Purge flow amount GPG map shown in FIG. 20 according to the control value DUTY and Pa−PM (difference between atmospheric pressure Pa and intake pipe pressure PM). It is to be noted that a map for obtaining the purge flow amount GPG by the control value DUTY and the intake pipe pressure PM may be produced.

Then, in the next step 824, a purge ratio PGR (=GPG/GA) is calculated from the intake air amount GA during introduction of negative pressure and the purge flow amount GPG.

$$PGR = GPG/GA$$

Thereafter, in step 825, the fuel injection amount correction value FAFLEAK is calculated from the following equation.

$$FAFLEAK=PGR\times(FGPGAV-1)\times K1$$

In the above equation, FGPGAV is a fuel evaporation gas density average value calculated in step 411 of FIG. 9, FGPGAV−1 being the air-fuel ratio feedback correction amount deviation per 1% purge ratio. Also, K1 is an error correction coefficient updated by the updating process of FIG. 18.

In the next step 826, the fuel injection amount correction value FAFLEAK is guard processed to below the upper limit guard value KFLEAKMX. At this time, the upper limit guard value KFLEAKMX is variably set according to Pa−PM (difference between atmospheric pressure Pa and intake pipe pressure PM) from the upper limit guard value KFLEAKMX table shown in FIG. 21. It is to be noted that, as a parameter for setting the upper limit guard value KFLEAKMX, in place of the difference between the atmospheric pressure Pa and the intake pipe pressure PM (Pa−PM), any one of the atmospheric pressure Pa and the intake pipe pressure PM alone may be used.

Thereafter, upon completion of negative pressure introduction at time T4 in FIG. 14 and resetting of the second flag F2 to "0", steps 821 to 827 are proceeded to, the fuel injection amount correction value FAFLEAK is set to 0, and the routine is completed.

Figure 17:
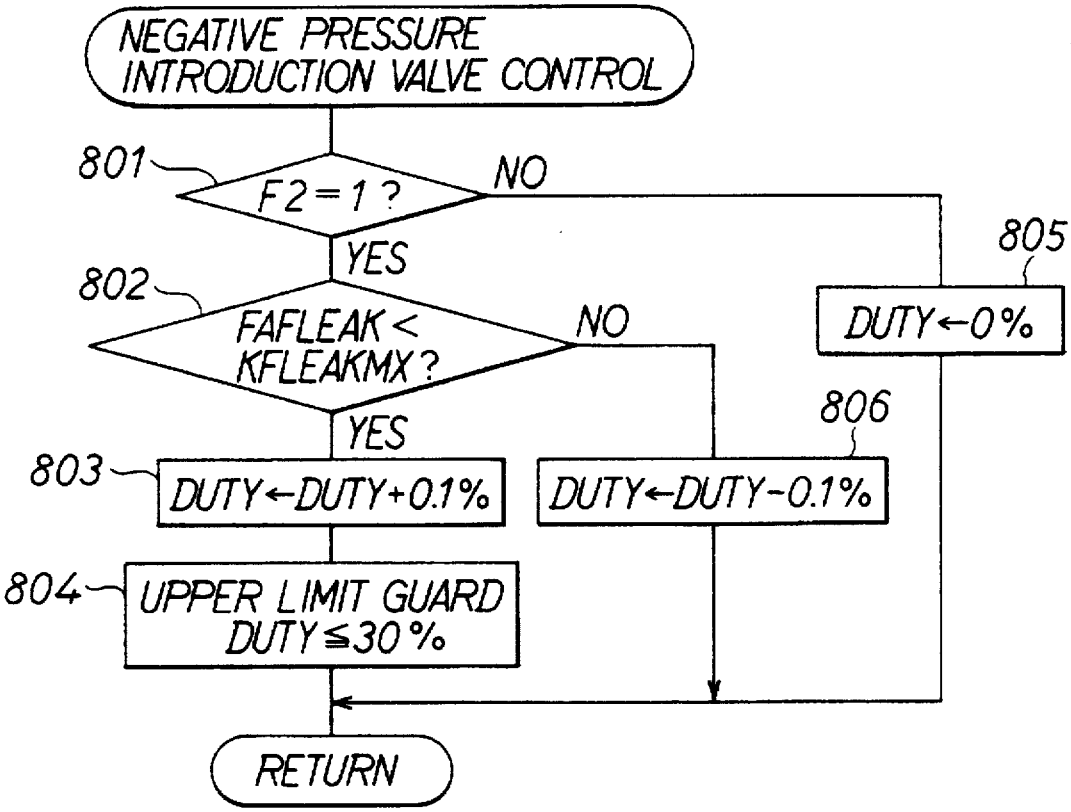
FIG. 17 is a flow chart showing the flow of processes in a purge control valve negative pressure introduction valve opening control routine in the case of DUTY control.
Figure 19:
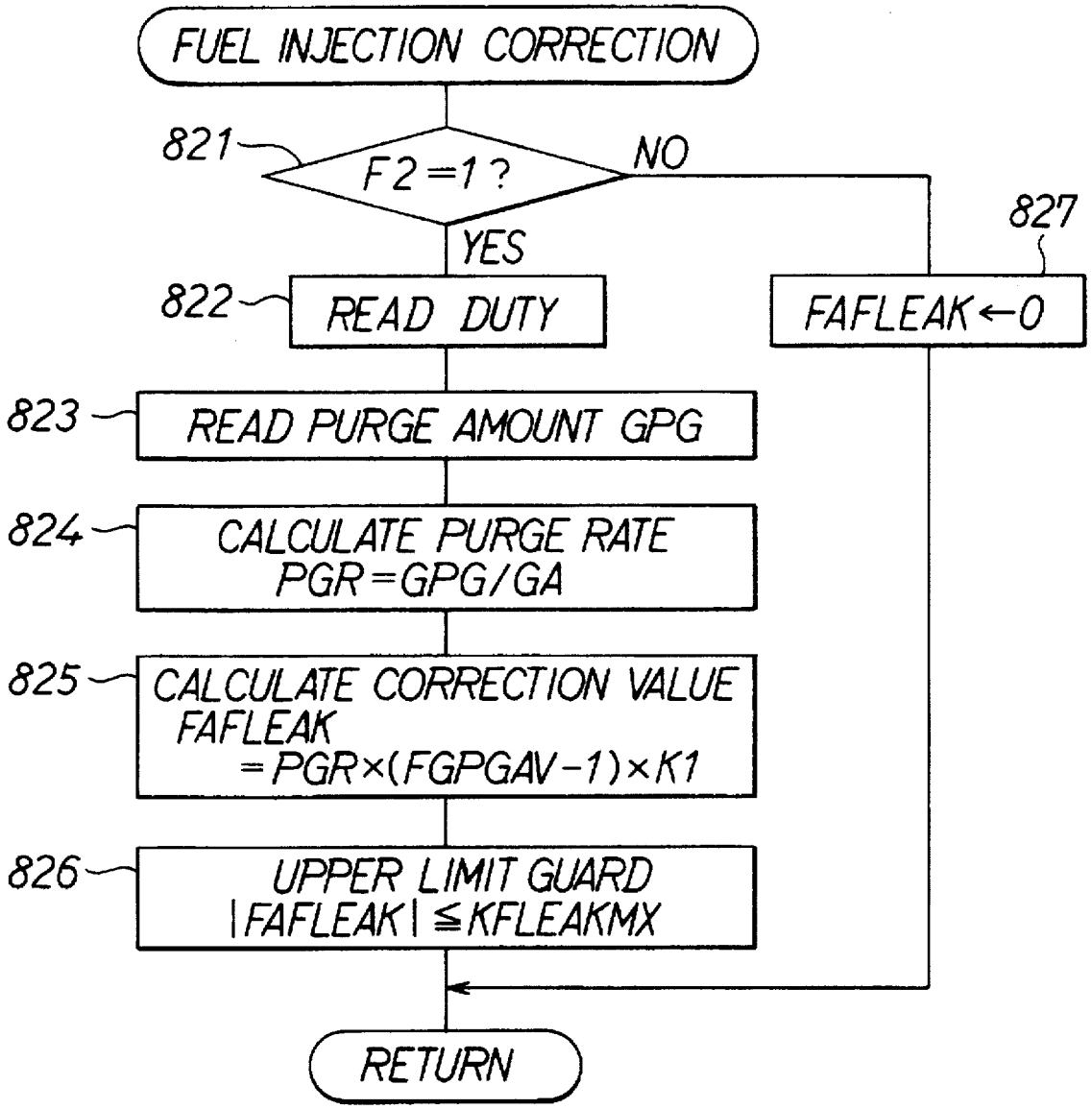
FIG. 19 is a flow chart showing the flow of processes in a fuel injection amount correction routine in the case of DUTY control.

In the process of FIG. 17 and FIG. 19 described above, although negative pressure introduction valve opening control is performed by control of the control value DUTY (valve opening amount) of the purge control valve 31, where controlling it by control of the purge ratio PGR, this can be done in the following manner.

Figure 22:
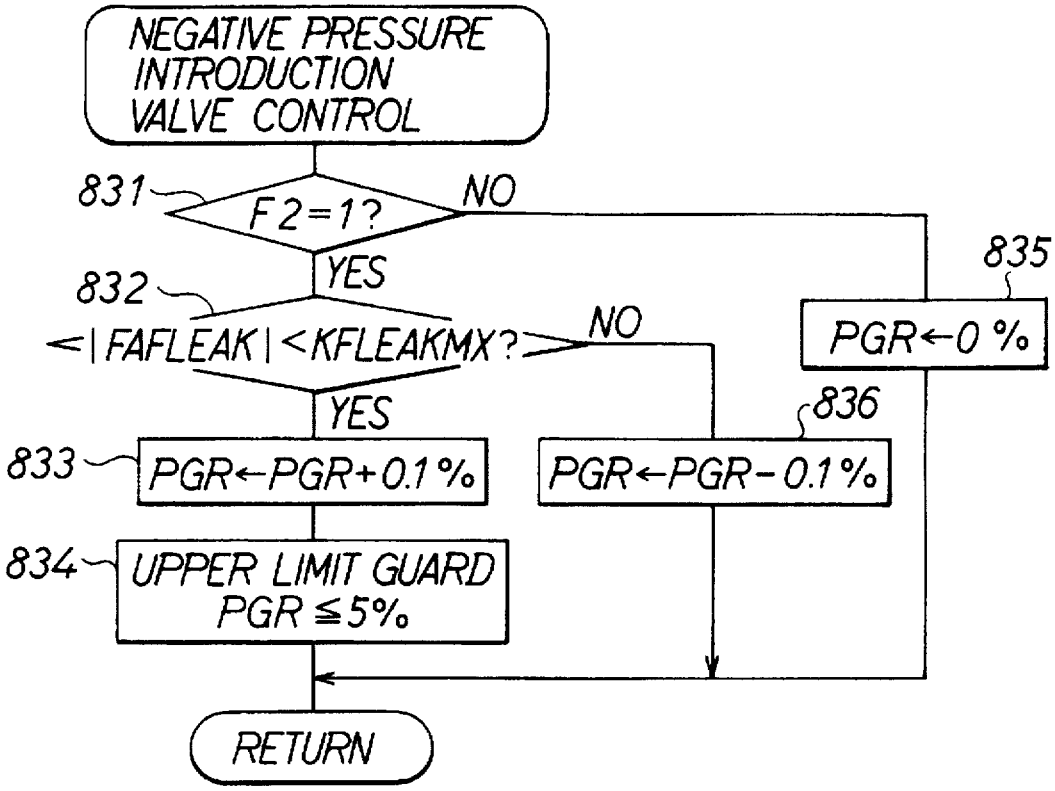
FIG. 22 is a flow chart showing the flow of processes in a purge control valve negative pressure introduction valve opening control routine in the case of purge ratio PGR control.

Purge Control Valve Negative Pressure Introduction Valve Opening Control in the Case of Purge Ratio PGR Control In the purge control valve negative pressure introduction valve opening control shown in FIG. 22, firstly, in step 831, whether the second flag F2 is "1" is determined, then where F2=1 (negative pressure introduction valve is open up to times T3 to T4 in FIG. 14), the process advances to step 832, where it is determined whether an absolute value of the fuel injection amount correction value |FAFLEAK| is lower than the upper limit guard value KFLEAKMX, and if |FAFLEAK|<KFLEAKMX, step 833 is proceeded to and the purge ratio PGR is increased by 0.1%, then in step 834 the purge ratio PGR is guard processed to below the upper limit guard value of 54%. Meanwhile, where |FAFLEAK|≧KFLEAKMX in step 832, step 836 is proceeded to and the purge ratio PGR is lowered by 0.1%.

Thereafter, at time T4 in FIG. 14, upon completion of negative pressure introduction and the second flag being reset to "0", steps 831 to 835 are proceeded to and the purge ratio PGR is set to 0%.

Fuel Injection Amount Correction in the Case of Purge Ratio PGR Control

Figure 23:
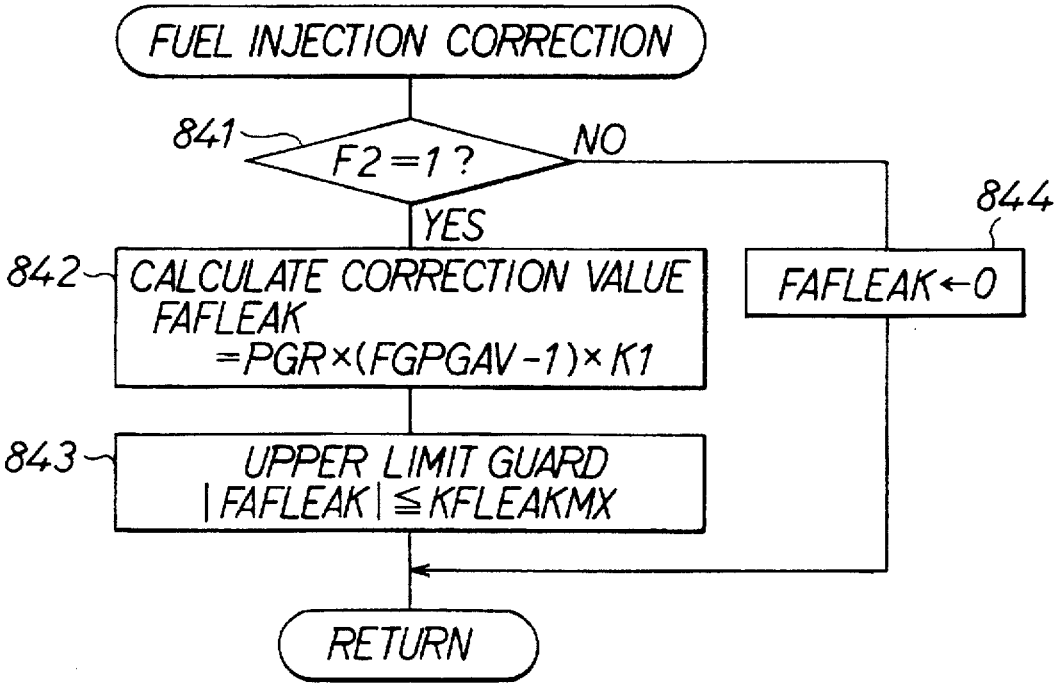
FIG. 23 is a flow chart showing the flow of processes in a fuel injection amount correction routine in the case of purge ratio PGR control.

Meanwhile, in the fuel injection amount correction routine shown in FIG. 23, firstly in step 841 whether the second flag F2 is "1" is determined, then where F2=1 (negative pressure introduction valve is open up to times T3 to T4 in FIG. 14), the process advances to step 842, where the fuel injection amount correction value FAFLEAK is calculated by means of the following equation.

$$FAFLEAK=PGR\times(FGPGAV-1)\times K1$$

In the above equation, PGR is a purge ratio updated by the process of FIG. 22, FGPGAV is a fuel evaporation gas density average value calculated in step 411 of FIG. 9 and FGPGAV−1 is the air-fuel ratio feedback correction amount deviation per 1% purge ratio. Also, K1 is an error correction coefficient updated by the updating process of FIG. 18.

In the next step 843, the fuel injection amount correction value FAFLEAK is guard processed to below the upper limit guard value KFLEAKMX. At this time, the upper limit guard value KFLEAKMX is variably set according to the intake pipe pressure PM from the upper limit guard value KFLEAKMX table shown in FIG. 24. As a parameter for setting the upper limit guard value KFLEAKMX, in place of the intake pipe pressure PM, the difference between the atmospheric pressure Pa and the intake pipe pressure PM may be used.

Thereafter, upon completion of negative pressure introduction and the second flag F2 being reset to "0" at time T4 in FIG. 14, steps 841 to 844 are proceeded to, the fuel injection amount correction value FAFLEAK is set to 0, and the routine is completed.

The present invention should not be limited to the embodiments described above but may be modified in various other ways without departing from the spirit of the invention.

What is claimed is:

1. An evaporated fuel gas purging system for au engine, said system comprising:

a fuel tank;

a canister for adsorbing evaporated fuel gas generated in the fuel tank;

an outside valve disposed to open and close the canister with respect to an outside atmosphere;

a purge passage for purging evaporated fuel gas adsorbed within the canister to an intake pipe of the engine;

a purge control valve disposed to open and close the purge passage;

purge control means for controlling evaporated fuel gas flow to the intake pipe according to an engine drive state when the outside valve is open irrespective of evaporated fuel concentration;

breakdown analysis means for introducing a negative intake pipe pressure into the canister by closing the outside valve and opening the purge control valve, and analyzing breakdowns irrespective of evaporated fuel concentration in at least one of the canister, the purge passage, the outside opening valve and the purge control valve; and fuel injection correction means for correcting an amount of fuel supplied to the engine according to evaporated fuel gas flow purged into the intake pipe from the canister when the purge control valve is open during operation of the breakdown analysis means.

2. An evaporated fuel gas purging system for an engine, said system comprising:

a fuel tank;

a canister for adsorbing evaporated fuel gas generated in the fuel an outside valve disposed to open and close the canister with respect to outside atmosphere;

a purge passage for purging evaporated fuel gas adsorbed within the canister to an intake pipe of the engine;

a purge control valve disposed to open and close the purge passage;

purge control means for controlling evaporated fuel gas flow to the intake pipe according to an engine drive state when the outside valve is open;

breakdown analysis means for introducing a negative intake pipe pressure into the canister by closing the outside valve and opening the purge control valve, and analyzing breakdowns in at least one of the canister, the purge passage, the outside opening valve and the purge control valve;

fuel injection correction means for correcting an amount of fuel supplied to the engine according to evaporated fuel gas flow purged into the intake pipe from the canister when the purge control valve is open during operation of the breakdown analysis means;

storing means for storing an air-fuel ratio feedback correction deviation per 1% of a purge ratio defined by an intake air flow during purging to a purge flow; and means for controlling purge control valve opening so that introduction of intake pipe negative pressure into the purge system is controlled to a predetermined purge ratio, wherein the fuel injection correction means calculates a fuel injection correction value by multiplying the purge ratio when intake pipe negative pressure is introduced into the purge system by the air-fuel ratio feedback correction deviation per 1% purge ratio.

3. The evaporated fuel gas purging system of claim 1, further comprising:

storing means for storing an air-fuel ratio feedback correction deviation per 1% of a purge ratio defined by an intake air flow during purging to a purge flow;

means for controlling the purge control valve to a predetermined opening during introduction of intake pipe negative pressure into the purge system; and means for obtaining a purge ratio by calculating at least one of: (i) a purge flow from the purge control valve opening and the intake pipe negative pressure at that time and (ii) a pressure difference between the intake pipe negative pressure and atmospheric pressure, wherein the fuel injection correction means calculates a fuel injection correction value by multiplying the purge ratio when intake pipe negative pressure is introduced into the purge system by the air-fuel ratio feedback correction deviation per 1% purge ratio.

4. The evaporated fuel gas purging system of claim 1, further comprising:

storing means for calculating a concentration of purged evaporated fuel gas based on a purge flow rate and an air-fuel ratio feedback correction obtained from a purge control valve opening during purge control by the purge control means, and storing a calculation result thereof, wherein the fuel injection correction means corrects fuel injection based on the concentration of evaporated fuel gas stored in the storing means and the purge flow of evaporated fuel gas purged into the intake pipe during operation of the breakdown analyzing means.

5. The evaporated fuel gas purging system of claim 4, wherein the fuel injection correction means includes error correction means for correcting errors due to closing of the outside vale during operation of the breakdown analyzing means.

6. The evaporated fuel gas purging system of claim 4, wherein the fuel injection correction means includes means for updating an error correction coefficient based on an air-fuel ratio feedback correction deviation during intake pipe negative pressure introduction.

7. An evaporated fuel gas purging system for an engine, said system comprising:

a fuel tank;

a canister for adsorbing evaporated fuel gas generated in the fuel tank;

an outside valve disposed to open and close the canister with respect to an outside atmosphere;

a purge passage for purging evaporated fuel gas adsorbed within the canister to an intake pipe of the engine;

a purge control valve disposed to open and close the purge passage;

purge control means for controlling evaporated fuel gas flow to the intake pipe according to an engine drive state when the outside valve is open;

breakdown analysis means for introducing a negative intake pipe pressure into the canister by closing the outside valve and opening the purge control valve, and analyzing breakdowns in at least one of the canister, the purge passage, the outside opening valve and the purge control valve;

fuel injection correction means for correcting an amount of fuel supplied to the engine according to evaporated fuel gas flow purged into the intake pipe from the canister when the purge control valve is open during operation of the breakdown analysis means;

wherein the fuel injection correction means includes means for limiting a fuel injection correction value to below an upper limit guard value.

8. An evaporated fuel gas purging system for an engine, said system comprising:

a fuel tank;

a canister for adsorbing evaporated fuel gas generated in the fuel tank;

an outside valve disposed to open and dose the canister with respect to an outside atmosphere;

a purge passage for purging evaporated fuel gas adsorbed within the canister to an intake pipe of the engine;

a purge control valve disposed to open and close the purge passage;

purge control means for controlling evaporated fuel gas flow to the intake pipe according to an engine drive state when the outside valve is open;

breakdown analysis means for introducing a negative intake pipe pressure into the canister by closing the outside valve and opening the purge control valve, and analyzing breakdowns in at least one of the canister, the purge passage, the outside opening valve and the purge control valve;

fuel injection correction means for correcting an amount of fuel supplied to the engine according to evaporated fuel gas flow purged into the intake pipe from the canister when the purge control valve is open during operation of the breakdown analysis means;

storing means for calculating a concentration of purged evaporated fuel gas based on a purge flow rate and air-fuel ratio feedback correction obtained from a purge control valve opening during purge control by the purge control means, and storing a calculation result thereof, wherein the fuel injection correction means corrects the fuel injection based on the concentration of evaporated fuel gas stored in the storing means and the purge flow Of evaporated fuel gas purged into the intake pipe during operation of the breakdown analyzing means;

wherein the fuel injection correction means includes means for updating an error correction coefficient based on an air-fuel ratio feedback correction deviation during intake pipe negative pressure introduction; and wherein the fuel injection correction means includes means for varying the upper limit guard value according to one of the intake pipe negative pressure, atmospheric pressure and a pressure difference between the intake pipe negative pressure and atmospheric pressure.

9. An evaporated fuel gas purging system for an engine, said system comprising:

a fuel tank;

a canister for adsorbing evaporated fuel gas generated in the fuel tank;

an outside valve disposed to open and close the canister with respect to an outside atmosphere;

a purge passage for purging evaporated fuel gas adsorbed within the canister to an intake pipe of the engine;

a purge control valve disposed to open and close the purge passage;

purge control means for controlling evaporated fuel gas flow to the intake pipe according to an engine drive state when the outside valve is open;

breakdown analysis means for introducing a negative intake pipe pressure into the canister by closing the outside valve and opening the purge control valve, and analyzing breakdowns in at least one of the canister, the purge passage, the outside opening valve and the purge control valve;

fuel injection correction means for correcting an amount of fuel supplied to the engine according to evaporated fuel gas flow purged into the intake pipe from the canister when the purge control valve is open during operation of the breakdown analysis means;

wherein the analysis means includes means for stopping introduction of intake pipe negative pressure and the breakdown analysis operation at least when (i) a fuel injection correction value is above a predetermined value, (ii) when the fuel injection correction value is above a predetermined value and an air-fuel ratio feedback correction deviation is above a predetermined value, and (iii) when the fuel injection correction value is above a predetermined value and the purge control valve opening is below a predetermined value.

10. The evaporated gas purging system of claim 1, further comprising:

purge control disabling means for disabling the purge control when breakdown analysis is effected.

11. An evaporated fuel gas purging system for an engine, said system comprising:

a fuel tank;

a canister for adsorbing evaporated fuel gas generated in the fuel tank;

an outside valve disposed to open and close the canister with respect to an outside atmosphere;

a purge passage for purging the evaporated fuel gas adsorbed within the canister to an intake pipe of the engine;

a purge control valve disposed to open and close the purge passage;

purge control means for controlling evaporated fuel gas flow purged to the intake pipe according to engine operating conditions when the outside valve is open;

breakdown analysis means for introducing a negative intake pipe pressure into the canister by closing the outside valve and opening the purge control valve, and analyzing breakdowns in at least one of the canister, the purge passage, the outside opening valve and the purge control valve;

first calculating means for calculating a first correction value based on density of evaporated fuel gas during purge control by the purge control means;

second calculation means for calculating a second correction value based on density of evaporated fuel gas during a breakdown analysis by the breakdown analysis means, the second correction value being different from the first correction value; and fuel injection correction means for correcting an amount of fuel supplied to the engine by the first and the second correction values during purge control and breakdown analysis, respectively.

12. The evaporated fuel gas purging system of claim 11, further comprising:

means for disabling purge control by the purge control means when breakdown analysis is being effected by the breakdown analysis means.

13. The evaporated fuel gas purging system of claim 11, wherein:

the second calculating means calculates the second correction value proportionally from the first correction value.

14. The evaporated fuel gas purging system of claim 11, wherein:

the purge control means performs purge control irrespective of evaporated fuel gas density.

15. The evaporated fuel gas purging system of claim 11, wherein:

the breakdown analysis means performs breakdown analysis irrespective of evaporated fuel gas density.

* * * * *